US009666940B2

(12) United States Patent
Behroozi et al.

(10) Patent No.: US 9,666,940 B2
(45) **Date of Patent: *May 30, 2017**

(54) BALLOON WITH PRESSURE MECHANISM TO PASSIVELY STEER ANTENNA

(71) Applicant: X Development LLC, Mountain View, CA (US)

(72) Inventors: Cyrus Behroozi, Palo Alto, CA (US); Eric Teller, Palo Alto, CA (US); Richard W. DeVaul, Mountain View, CA (US)

(73) Assignee: X Development LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/003,760

(22) Filed: Jan. 21, 2016

(65) Prior Publication Data

US 2016/0149301 A1 May 26, 2016

Related U.S. Application Data

(63) Continuation of application No. 13/863,485, filed on Apr. 16, 2013, now Pat. No. 9,281,554.

(51) Int. Cl.

| | |
|---|---|
| ***H01Q 1/28*** | (2006.01) |
| ***H01Q 3/08*** | (2006.01) |
| ***H01Q 1/08*** | (2006.01) |
| ***H01Q 15/14*** | (2006.01) |
| ***H01Q 3/06*** | (2006.01) |

(52) U.S. Cl.

CPC ..... *H01Q 3/08* (2013.01); *H01Q 1/082* (2013.01); *H01Q 1/28* (2013.01); *H01Q 3/06* (2013.01); *H01Q 15/14* (2013.01)

(58) Field of Classification Search

CPC ..... H01Q 1/28

USPC ..... 343/706; 244/94, 97, 98, 99

See application file for complete search history.

(56) References Cited

U.S. PATENT DOCUMENTS

| | | | | |
|---|---|---|---|---|
| 2,740,598 A | | 4/1956 | E.R. Van Krevelen | |
| 2,742,246 A | | 4/1956 | Mellen | |
| 3,742,358 A | * | 6/1973 | Cesaro | H04B 7/18504 343/705 |
| 6,072,524 A | | 6/2000 | Davis | |
| 6,371,408 B1 | | 4/2002 | Halwes | |
| 6,628,941 B2 | * | 9/2003 | Knoblach | H04B 7/18576 455/431 |
| 7,558,569 B2 | * | 7/2009 | Chang | H04B 7/18506 455/12.1 |

(Continued)

FOREIGN PATENT DOCUMENTS

| | | |
|---|---|---|
| GB | 549549 | 11/1942 |

*Primary Examiner* — Huedung Mancuso

(74) *Attorney, Agent, or Firm* — McDonnell Boehnen Hulbert & Berghoff LLP

(57) ABSTRACT

Methods and apparatus are disclosed for passively steering an antenna disposed on a balloon in a balloon network. An example balloon involves: (a) an antenna and (b) a pressure-sensitive mechanism in mechanical communication with the antenna such that a change in the balloon's altitude causes at least an element of the antenna to rotate upward or downward, a separation distance between two or more radiating elements to increase or decrease, or a separation distance between the two or more radiating elements and a reflector to increase or decrease.

20 Claims, 12 Drawing Sheets

(56) References Cited

U.S. PATENT DOCUMENTS

| | | | | |
|---|---|---|---|---|
| 7,567,779 | B2 | 7/2009 | Seligsohn et al. | |
| 7,715,838 | B2 * | 5/2010 | Swensen | H04B 7/18506 244/158.1 |
| 8,483,120 | B2 | 7/2013 | Seligsohn | |
| 9,010,691 | B1 * | 4/2015 | Ratner | B64D 17/64 244/142 |

* cited by examiner

BALLOON WITH PRESSURE MECHANISM TO PASSIVELY STEER ANTENNA

CROSS-REFERENCE TO RELATED APPLICATION

This application claims the benefit of the filing date of U.S. Non-Provisional patent application Ser. No. 13/863,485, filed Apr. 16, 2013, which is hereby incorporated by reference in its entirety.

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. As such, the demand for data connectivity via the Internet, cellular data networks, and other such networks, is growing. However, there are many areas of the world where data connectivity is still unavailable, or if available, is unreliable and/or costly. Accordingly, additional network infrastructure is desirable.

SUMMARY

In one aspect, an example balloon involves: (a) an antenna and (b) a pressure-sensitive mechanism in mechanical communication with the antenna such that a change in the balloon's altitude causes at least an element of the antenna to rotate upward or downward, a separation distance between two or more radiating elements to increase or decrease, or a separation distance between the two or more radiating elements and a reflector to increase or decrease.

In one embodiment, this aspect further comprises a calibration system comprising a zero-power-hold actuator and a processor, wherein the zero-power-hold actuator is in mechanical communication with the antenna.

In another aspect, an example method involves: (a) providing a first balloon that includes an antenna comprising a reflector and a radiating element, wherein the antenna has a base end and a signalling end, and a pressure-sensitive mechanism in mechanical communication with the antenna at a first altitude, (b) navigating the balloon to a second altitude, and (c) in response, if the second altitude is higher than the first altitude, expanding a component of the pressure-sensitive mechanism and rotating an antenna beam pattern downward, or if the second altitude is lower than the first altitude, contracting the component of the pressure-sensitive mechanism and rotating the antenna beam pattern upward.

In a further aspect, an example balloon involves: (a) an antenna and (b) means for causing at least an element of the antenna to rotate upward or downward, a separation distance between two or more radiating elements to increase or decrease, or a separation distance between the two or more radiating elements and a reflector to increase or decrease in response to a change in the balloon's altitude.

These as well as other aspects, advantages, and alternatives, will become apparent to those of ordinary skill in the art by reading the following detailed description, with reference where appropriate to the accompanying drawings.

DETAILED DESCRIPTION

Figure 1:
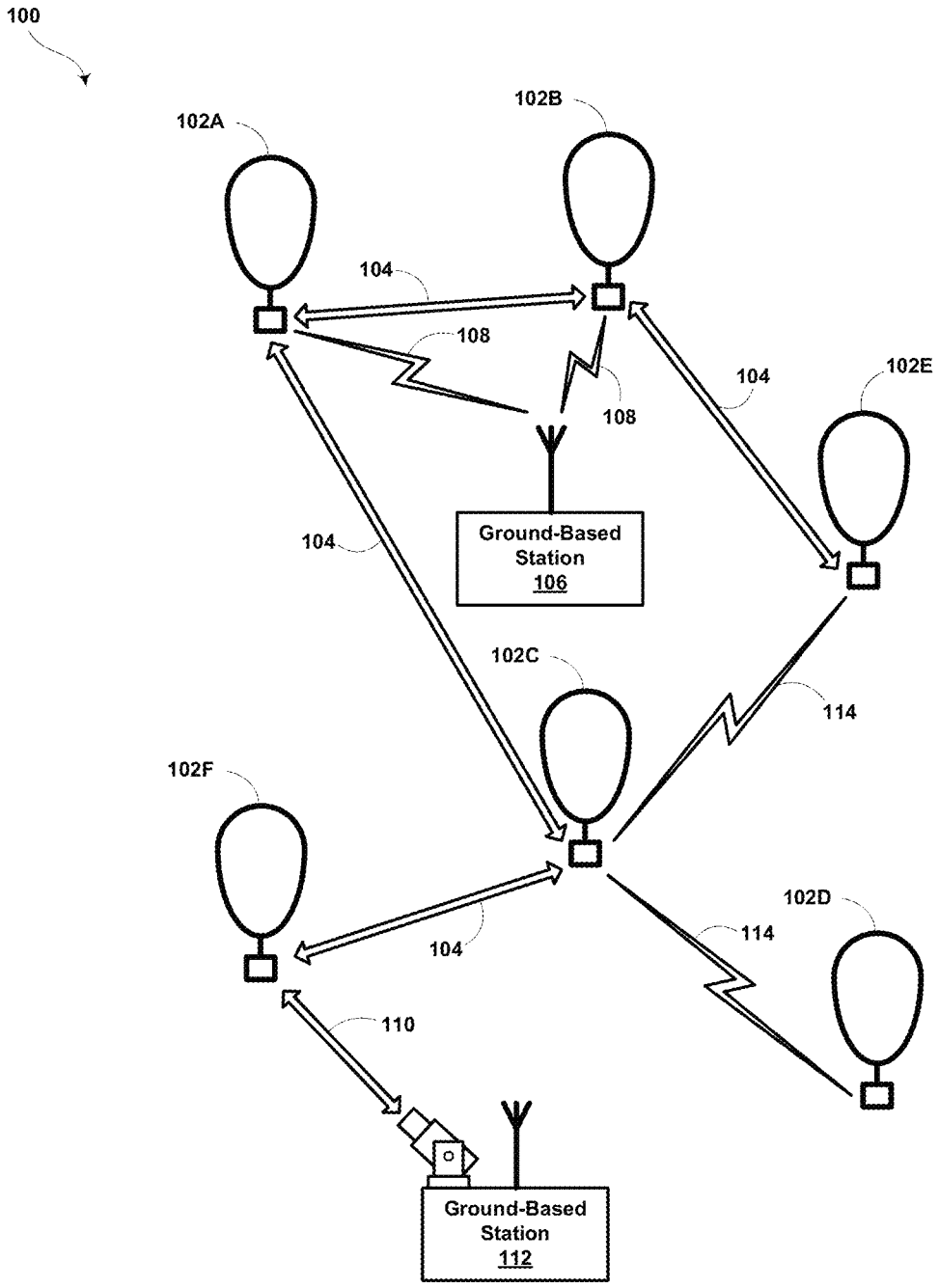
FIG. 1 is a simplified diagram illustrating a balloon network, according to an example embodiment.

Example methods and systems are described herein. Any example embodiment or feature described herein is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments may include more or less of each element shown in a given Figure. Further, some of the illustrated elements may be combined or omitted. Yet further, an example embodiment may include elements that are not illustrated in the Figures.

1. Overview

Example embodiments disclosed herein can generally relate to a data network formed by balloons, and in particular, to a mesh network formed by high-altitude balloons deployed in the stratosphere. In order that the balloons can provide a reliable mesh network in the stratosphere, where winds may affect the locations of the various balloons in an asymmetrical manner, the balloons in an exemplary network can be configured to move latitudinally and/or longitudinally relative to one another by adjusting their respective altitudes, so that winds aloft can carry the respective balloons to the respectively desired locations.

In some cases, the balloon can send communication signals. For example, the balloon can generate data, such as diagnostic data about the balloon or communications to other balloons in the network, that can be converted into communications signals for transmission. In other cases, the balloon can receive communications signals from other balloons in the network or signals that include navigational data from GPS or other navigational satellites. In yet other cases, the balloon can both send and receive communication signals. For example, the balloon can receive signals from one balloon in the network and relay the signals, perhaps after modification, to another balloon or communications device.

To function as a node in a balloon network, high-altitude balloons may engage in balloon-to-balloon communication via antennas. As one or more of the communicating balloons change altitude or latitude relative to the other balloon(s), the antennas may move out of alignment resulting in a broken communication link. Specifically, if a first balloon rises while the second balloon stays at the same altitude, the rising first balloon may need to angle its antenna downward to maintain antenna alignment and communication with the stationary second balloon. Alternatively, if the first balloon decreases its altitude while the second balloon stays at the same altitude, the falling first balloon may need to angle its antenna upward. In both scenarios, the second balloon's antenna may need to realign its antenna slightly to accommodate the new angle of the first balloon's antenna.

Further, the balloon-to-balloon antennas have a limited vertical beam width of, for example, 5 degrees. It is advantageous to make this beam width as narrow as possible through adjustments in spacing between a reflector and a radiating element of the antenna, which allows the antenna to better focus radiated power and enable communications over a longer distance. For example, if a first balloon is at the top of its altitude range, neighbor balloons will be level with or at a lower altitude, and the first balloon's beam will have no need to point upward. Instead, the first balloon's antenna can utilize a narrower beam that only points horizontally and lower. Likewise, a balloon at the bottom of its navigable altitude range only needs to point horizontally and upward, again allowing for the use of a narrower beam width. In addition, a first balloon at the center of the altitude range radiates a signal to reach neighbour balloons both above and below the first balloon, but will still be within a range that allows the use of a narrower beam width. Accordingly, if the beam can be tilted upward and downward, only half the beam width is necessary compared to a system with fixed antennas, resulting in significantly increased signal range.

In a further embodiment, the antenna may be in communication ground-facing to serve users on the ground. In this instance, instead of rotating the beam pattern, the beam pattern is expanded or contracted to cover the same footprint on the ground regardless of altitude. Specifically, an antenna reflector should be closer to radiating elements at a low end of the balloon's altitude range and further from the radiating elements at the high end of the altitude range.

In addition, a balloon may consume a significant amount of power as a node in a balloon network and it is desirable to minimize unnecessary power consumption. Accordingly, an exemplary embodiment may include an antenna in mechanical communication with a passive antenna steering system.

In an example embodiment, the passive steering mechanism includes an "aneroid." An aneroid comprises a chamber with a first surface, a second surface and at least one collapsible sidewall. The collapsible sidewall may be corrugated or pleated or alternatively may comprise a pliable material. The chamber may contain a "partial vacuum" meaning an enclosed space from which part of the air or another gas has been removed, the net result of which is that the air remaining in the space exerts less pressure than the atmosphere. In operation, when the air pressure outside the chamber increases or decreases due to changes in the balloon's altitude, the collapsible sidewall allows the aneroid to contract or expand, respectively. In turn, the aneroid mechanically angles the horizontally directed-antenna beam pattern downward as the aneroid expands or upward as the aneroid contracts.

In another example embodiment, the passive steering mechanism includes a "Bourdon tube." A Bourdon tube comprises a thin-walled flattened tube of elastic metal bent into a circular arc or a helix that is evacuated and sealed. When the pressure outside the tube decreases, the tube tends to contract and straighten out or uncoil. This motion is converted into the rotation of the antenna and/or an adjustment in the spacing of the radiating element relative to the reflector.

In some embodiments, a calibration system is employed as part of the passive antenna steering system that includes a zero-power-hold actuator and a processor. The "zero-power-hold actuator" reorients the antenna by acting upon and repositioning one of the aneroid, an antenna pivot or a movable support to calibrate the system based on the altitude of and the distance to a second balloon in the network, as well as the antenna signal's beam width. In order to reposition one or more of the foregoing elements, electric power is supplied to the zero-power-hold actuator from a power source for only a brief period of time. Examples of a zero-power-hold actuator include piezoelectric motors, servomotors, and solenoids. The zero-power-hold actuator may be in direct contact with the steering system element targeted for movement or may be in communication with an adjustment element, such as, a set screw or a magnet, that interfaces with the target. By changing the angle or position of the aneroid or the tension of the tension spring, the steering system calibrates the degree to which the aneroid's expansion and contraction can affect the angle of the antenna.

The use of a passive antenna steering system minimizes drain on the balloon's power source, freeing up power for other applications and allowing the balloon to stay aloft for longer periods of time. Further, by enhancing the ability of the balloon to communicate, the balloon is able to increase performance via better navigation; i.e., using GPS, carrying out additional communications and providing additional services; e.g., balloon-to-balloon communication.

2. Example Balloon Networks

In an example balloon network, the balloons may communicate with one another using free-space optical communications. For instance, the balloons may be configured for optical communications using ultra-bright LEDs (which are also referred to as "high-power" or "high-output" LEDs). In some instances, lasers could be used instead of or in addition to LEDs, although regulations for laser communications may restrict laser usage. In addition, the balloons may communicate with ground-based station(s) using radio-frequency (RF) communications.

In some embodiments, a high-altitude-balloon network may be homogenous. That is, the balloons in a high-altitude-balloon network could be substantially similar to each other in one or more ways. More specifically, in a homogenous high-altitude-balloon network, each balloon is configured to communicate with nearby balloons via free-space optical links. Further, some or all of the balloons in such a network, may also be configured to communicate with ground-based station(s) using RF communications. (Note that in some embodiments, the balloons may be homogenous in so far as each balloon is configured for free-space optical communication with other balloons, but heterogeneous with regard to RF communications with ground-based stations.)

In other embodiments, a high-altitude-balloon network may be heterogeneous, and thus may include two or more different types of balloons. For example, some balloons may be configured as super-nodes, while other balloons may be configured as sub-nodes. Some balloons may be configured to function as both a super-node and a sub-node. Such balloons may function as either a super-node or a sub-node at a particular time, or, alternatively, act as both simultaneously depending on the context. For instance, an example balloon could aggregate search requests of a first type to transmit to a ground-based station. The example balloon could also send search requests of a second type to another balloon, which could act as a super-node in that context.

In such a configuration, the super-node balloons may be configured to communicate with nearby super-node balloons via free-space optical links. However, the sub-node balloons may not be configured for free-space optical communication, and may instead be configured for some other type of communication, such as RF communications. In that case, a super-node may be further configured to communicate with sub-nodes using RF communications. Thus, the sub-nodes may relay communications between the super-nodes and one or more ground-based stations using RF communications. In this way, the super-nodes may collectively function as backhaul for the balloon network, while the sub-nodes function to relay communications from the super-nodes to ground-based stations. Other differences could be present between balloons in a heterogeneous balloon network.

FIG. 1 is a simplified diagram illustrating a balloon network 100, according to an example embodiment. As shown, balloon network 100 includes balloons 102A to 102F, which are configured to communicate with one another via free-space optical links 104. Balloons 102A to 102F could additionally or alternatively be configured to communicate with one another via RF links 114. Balloons 102A to 102F may collectively function as a mesh network for packet-data communications. Further, balloons 102A to 102F may be configured for RF communications with ground-based stations 106 and 112 via RF links 108. In another example embodiment, balloons 102A to 102F could be configured to communicate via optical link 110 with ground-based station 112.

In an example embodiment, balloons 102A to 102F are high-altitude balloons, which are deployed in the stratosphere. At moderate latitudes, the stratosphere includes altitudes between approximately 10 kilometers (km) and 50 km altitude above the surface. At the poles, the stratosphere starts at an altitude of approximately 8 km. In an example embodiment, high-altitude balloons may be generally configured to operate in an altitude range within the stratosphere that has lower winds (e.g., between 5 and 20 miles per hour (mph)).

More specifically, in a high-altitude-balloon network, balloons 102A to 102F may generally be configured to operate at altitudes between 17 km and 25 km (although other altitudes are possible). This altitude range may be advantageous for several reasons. In particular, this layer of the stratosphere generally has mild wind and turbulence (e.g., winds between 5 and 20 miles per hour (mph)). Further, while the winds between 17 km and 25 km may vary with latitude and by season, the variations can be modelled in a reasonably accurate manner. Additionally, altitudes above 17 km are typically above the maximum flight level designated for commercial air traffic. Therefore, interference with commercial flights is not a concern when balloons are deployed between 17 km and 25 km.

To transmit data to another balloon, a given balloon 102A to 102F may be configured to transmit an optical signal via an optical link 104. In an example embodiment, a given balloon 102A to 102F may use one or more high-power light-emitting diodes (LEDs) to transmit an optical signal. Alternatively, some or all of balloons 102A to 102F may include laser systems for free-space optical communications over optical links 104. Other types of free-space optical communication are possible. Further, in order to receive an optical signal from another balloon via an optical link 104, a given balloon 102A to 102F may include one or more optical receivers. Additional details of example balloons are discussed in greater detail below, with reference to FIG. 3.

In a further aspect, balloons 102A to 102F may utilize one or more of various different RF air-interface protocols for communication ground-based stations 106 and 112 via RF links 108. For instance, some or all of balloons 102A to 102F may be configured to communicate with ground-based stations 106 and 112 using protocols described in IEEE 802.11 (including any of the IEEE 802.11 revisions), various cellular protocols such as GSM, CDMA, UMTS, EV-DO, WiMAX, and/or LTE, and/or one or more propriety protocols developed for balloon-to-ground RF communication, among other possibilities.

In a further aspect, there may scenarios where RF links 108 do not provide a desired link capacity for balloon-to-ground communications. For instance, increased capacity may be desirable to provide backhaul links from a ground-based gateway, and in other scenarios as well. Accordingly, an example network may also include downlink balloons, which could provide a high-capacity air-ground link.

For example, in balloon network 100, balloon 102F could be configured as a downlink balloon. Like other balloons in an example network, a downlink balloon 102F may be operable for optical communication with other balloons via optical links 104. However, downlink balloon 102F may also be configured for free-space optical communication with a ground-based station 112 via an optical link 110. Optical link 110 may therefore serve as a high-capacity link (as compared to an RF link 108) between the balloon network 100 and a ground-based station 112.

Note that in some implementations, a downlink balloon 102F may additionally be operable for RF communication with ground-based stations 106. In other cases, a downlink balloon 102F may only use an optical link for balloon-to-ground communications. Further, while the arrangement shown in FIG. 1 includes just one downlink balloon 102F, an example balloon network can also include multiple downlink balloons. On the other hand, a balloon network can also be implemented without any downlink balloons.

In other implementations, a downlink balloon may be equipped with a specialized, high-bandwidth RF communication system for balloon-to-ground communications, instead of, or in addition to, a free-space optical communication system. The high-bandwidth RF communication system may take the form of an ultra-wideband system, which provides an RF link with substantially the same capacity as the optical links 104. Other forms are also possible.

Balloons could be configured to establish a communication link with space-based satellites in addition to, or as an alternative to, a ground-based communication link.

Ground-based stations, such as ground-based stations 106 and/or 112, may take various forms. Generally, a ground-based station may include components such as transceivers, transmitters, and/or receivers for communication via RF links and/or optical links with a balloon network. Further, a ground-based station may use various air-interface protocols in order communicate with a balloon 102A to 102F over an RF link 108. As such, ground-based stations 106 and 112 may be configured as an access point with which various devices can connect to balloon network 100. Ground-based stations 106 and 112 may have other configurations and/or serve other purposes without departing from the scope of the invention.

Further, some ground-based stations, such as ground-based stations 106 and 112, may be configured as gateways between balloon network 100 and one or more other networks. Such ground-based stations 106 and 112 may thus serve as an interface between the balloon network and the Internet, a cellular service provider's network, and/or other types of networks. Variations on this configuration and other configurations of ground-based stations 106 and 112 are also possible.

2a) Mesh Network Functionality

As noted, balloons 102A to 102F may collectively function as a mesh network. More specifically, since balloons 102A to 102F may communicate with one another using free-space optical links, the balloons may collectively function as a free-space optical mesh network.

In a mesh-network configuration, each balloon 102A to 102F may function as a node of the mesh network, which is operable to receive data directed to it and to route data to other balloons. As such, data may be routed from a source balloon to a destination balloon by determining an appropriate sequence of optical links between the source balloon and the destination balloon. These optical links may be collectively referred to as a "lightpath" for the connection between the source and destination balloons. Further, each of the optical links may be referred to as a "hop" on the lightpath.

To operate as a mesh network, balloons 102A to 102F may employ various routing techniques and self-healing algorithms. In some embodiments, a balloon network 100 may employ adaptive or dynamic routing, where a lightpath between a source and destination balloon is determined and set-up when the connection is needed, and released at a later time. Further, when adaptive routing is used, the lightpath may be determined dynamically depending upon the current state, past state, and/or predicted state of the balloon network.

In addition, the network topology may change as the balloons 102A to 102F move relative to one another and/or relative to the ground. Accordingly, an example balloon network 100 may apply a mesh protocol to update the state of the network as the topology of the network changes. For example, to address the mobility of the balloons 102A to 102F, balloon network 100 may employ and/or adapt various techniques that are employed in mobile ad hoc networks (MANETs). Other examples are possible as well.

In some implementations, a balloon network 100 may be configured as a transparent mesh network. More specifically, in a transparent balloon network, the balloons may include components for physical switching that is entirely optical, without any electrical involved in physical routing of optical signals. Thus, in a transparent configuration with optical switching, signals travel through a multi-hop lightpath that is entirely optical.

In other implementations, the balloon network 100 may implement a free-space optical mesh network that is opaque. In an opaque configuration, some or all balloons 102A to 102F may implement optical-electrical-optical (OEO) switching. For example, some or all balloons may include optical cross-connects (OXCs) for OEO conversion of optical signals. Other opaque configurations are also possible. Additionally, network configurations are possible that include routing paths with both transparent and opaque sections.

In a further aspect, balloons in an example balloon network 100 may implement wavelength division multiplexing (WDM), which may help to increase link capacity. When WDM is implemented with transparent switching, physical lightpaths through the balloon network may be subject to the "wavelength continuity constraint." More specifically, because the switching in a transparent network is entirely optical, it may be necessary to assign the same wavelength for all optical links on a given lightpath.

An opaque configuration, on the other hand, may avoid the wavelength continuity constraint. In particular, balloons in an opaque balloon network may include the OEO switching systems operable for wavelength conversion. As a result, balloons can convert the wavelength of an optical signal at each hop along a lightpath. Alternatively, optical wavelength conversion could take place at only selected hops along the lightpath.

Further, various routing algorithms may be employed in an opaque configuration. For example, to determine a primary lightpath and/or one or more diverse backup lightpaths for a given connection, example balloons may apply or consider shortest-path routing techniques such as Dijkstra's algorithm and k-shortest path, and/or edge and node-diverse or disjoint routing such as Suurballe's algorithm, among others. Additionally or alternatively, techniques for maintaining a particular Quality of Service (QoS) may be employed when determining a lightpath. Other techniques are also possible.

2b) Station-Keeping Functionality

In an example embodiment, a balloon network 100 may implement station-keeping functions to help provide a desired network topology. For example, station-keeping may involve each balloon 102A to 102F maintaining and/or moving into a certain position relative to one or more other balloons in the network (and possibly in a certain position relative to the ground). As part of this process, each balloon 102A to 102F may implement station-keeping functions to determine its desired positioning within the desired topology, and if necessary, to determine how to move to the desired position.

The desired topology may vary depending upon the particular implementation. In some cases, balloons may implement station-keeping to provide a substantially uniform topology. In such cases, a given balloon 102A to 102F may implement station-keeping functions to position itself at substantially the same distance (or within a certain range of distances) from adjacent balloons in the balloon network 100.

In other cases, a balloon network 100 may have a non-uniform topology. For instance, example embodiments may involve topologies where balloons are distributed more or less densely in certain areas, for various reasons. As an example, to help meet the higher bandwidth demands that are typical in urban areas, balloons may be clustered more densely over urban areas. For similar reasons, the distribution of balloons may be denser over land than over large bodies of water. Many other examples of non-uniform topologies are possible.

In a further aspect, the topology of an example balloon network may be adaptable. In particular, station-keeping functionality of example balloons may allow the balloons to adjust their respective positioning in accordance with a change in the desired topology of the network. For example, one or more balloons could move to new positions to increase or decrease the density of balloons in a given area. Other examples are possible.

In some embodiments, a balloon network 100 may employ an energy function to determine if and/or how balloons should move to provide a desired topology. In particular, the state of a given balloon and the states of some or all nearby balloons may be input to an energy function. The energy function may apply the current states of the given balloon and the nearby balloons to a desired network state (e.g., a state corresponding to the desired topology). A vector indicating a desired movement of the given balloon may then be determined by determining the gradient of the energy function. The given balloon may then determine appropriate actions to take in order to effectuate the desired movement. For example, a balloon may determine an altitude adjustment or adjustments such that winds will move the balloon in the desired manner.

2c) Control of Balloons in a Balloon Network

Figure 2:
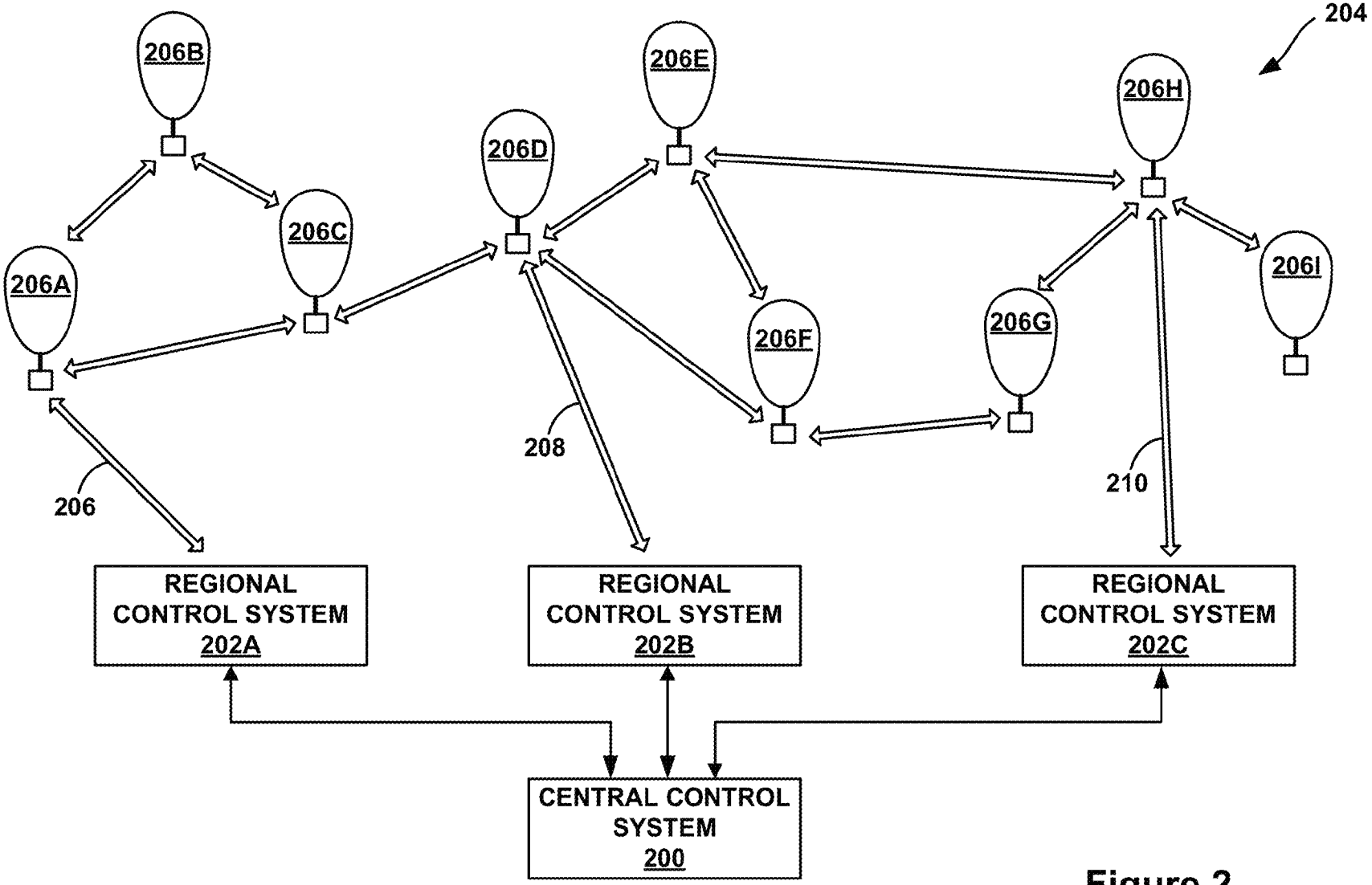
FIG. 2 is a diagram illustrating a balloon-network control system, according to an example embodiment.

In some embodiments, mesh networking and/or station-keeping functions may be centralized. For example, FIG. 2 is a diagram illustrating a balloon-network control system, according to an example embodiment. In particular, FIG. 2 shows a distributed control system, which includes a central control system 200 and a number of regional control-systems 202A to 202B. Such a control system may be configured to coordinate certain functionality for balloon network 204, and as such, may be configured to control and/or coordinate certain functions for balloons 206A to 206I.

In the illustrated embodiment, central control system 200 may be configured to communicate with balloons 206A to 206I via number of regional control systems 202A to 202C. These regional control systems 202A to 202C may be configured to receive communications and/or aggregate data from balloons in the respective geographic areas that they cover, and to relay the communications and/or data to central control system 200. Further, regional control systems 202A to 202C may be configured to route communications from central control system 200 to the balloons in their respective geographic areas. For instance, as shown in FIG. 2, regional control system 202A may relay communications and/or data between balloons 206A to 206C and central control system 200, regional control system 202B may relay communications and/or data between balloons 206D to 206F and central control system 200, and regional control system 202C may relay communications and/or data between balloons 206G to 206I and central control system 200.

In order to facilitate communications between the central control system 200 and balloons 206A to 206I, certain balloons may be configured as downlink balloons, which are operable to communicate with regional control systems 202A to 202C. Accordingly, each regional control system 202A to 202C may be configured to communicate with the downlink balloon or balloons in the respective geographic area it covers. For example, in the illustrated embodiment, balloons 206A, 206F, and 206I are configured as downlink balloons. As such, regional control systems 202A to 202C may respectively communicate with balloons 206A, 206F, and 206I via optical links 206, 208, and 210, respectively.

In the illustrated configuration, where only some of balloons 206A to 206I are configured as downlink balloons, the balloons 206A, 206F, and 206I that are configured as downlink balloons may function to relay communications from central control system 200 to other balloons in the balloon network, such as balloons 206B to 206E, 206G, and 206H. However, it should be understood that it in some implementations, it is possible that all balloons may function as downlink balloons. Further, while FIG. 2 shows multiple balloons configured as downlink balloons, it is also possible for a balloon network to include only one downlink balloon.

Note that a regional control system 202A to 202C may in fact just be a particular type of ground-based station that is configured to communicate with downlink balloons (e.g. the ground-based station 112 of FIG. 1). Thus, while not shown in FIG. 2, a control system may be implemented in conjunction with other types of ground-based stations (e.g., access points, gateways, etc.).

In a centralized control arrangement, such as that shown in FIG. 2, the central control system 200 (and possibly regional control systems 202A to 202C as well) may coordinate certain mesh-networking functions for balloon network 204. For example, balloons 206A to 206I may send the central control system 200 certain state information, which the central control system 200 may utilize to determine the state of balloon network 204. The state information from a given balloon may include location data, optical-link information (e.g., the identity of other balloons with which the balloon has established an optical link, the bandwidth of the link, wavelength usage and/or availability on a link, etc.), wind data collected by the balloon, and/or other types of information. Accordingly, the central control system 200 may aggregate state information from some or all the balloons 206A to 206I in order to determine an overall state of the network.

The overall state of the network may then be used to coordinate and/or facilitate certain mesh-networking functions such as determining lightpaths for connections. For example, the central control system 200 may determine a current topology based on the aggregate state information from some or all the balloons 206A to 206I. The topology may provide a picture of the current optical links that are available in the balloon network and/or the wavelength availability on the links. This topology may then be sent to some or all of the balloons so that a routing technique may be employed to select appropriate lightpaths (and possibly backup lightpaths) for communications through the balloon network 204.

In a further aspect, the central control system 200 (and possibly regional control systems 202A to 202C as well) may also coordinate certain station-keeping functions for balloon network 204. For example, the central control system 200 may input state information that is received from balloons 206A to 206I to an energy function, which may effectively compare the current topology of the network to a desired topology, and provide a vector indicating a direction of movement (if any) for each balloon, such that the balloons can move towards the desired topology. Further, the central control system 200 may use altitudinal wind data to determine respective altitude adjustments that may be initiated to achieve the movement towards the desired topology. The central control system 200 may provide and/or support other station-keeping functions as well.

FIG. 2 shows a distributed arrangement that provides centralized control, with regional control systems 202A to 202C coordinating communications between a central control system 200 and a balloon network 204. Such an arrangement may be useful to provide centralized control for a balloon network that covers a large geographic area. In some embodiments, a distributed arrangement may even support a global balloon network that provides coverage everywhere on earth. A distributed-control arrangement may be useful in other scenarios as well.

Further, it should be understood that other control-system arrangements are possible. For instance, some implementations may involve a centralized control system with additional layers (e.g., sub-region systems within the regional control systems, and so on). Alternatively, control functions may be provided by a single, centralized, control system, which communicates directly with one or more downlink balloons.

In some embodiments, control and coordination of a balloon network may be shared between a ground-based control system and a balloon network to varying degrees, depending upon the implementation. In fact, in some embodiments, there may be no ground-based control systems. In such an embodiment, all network control and coordination functions may be implemented by the balloon network itself. For example, certain balloons may be configured to provide the same or similar functions as central control system 200 and/or regional control systems 202A to 202C. Other examples are also possible.

Furthermore, control and/or coordination of a balloon network may be de-centralized. For example, each balloon may relay state information to, and receive state information from, some or all nearby balloons. Further, each balloon may relay state information that it receives from a nearby balloon to some or all nearby balloons. When all balloons do so, each balloon may be able to individually determine the state of the network. Alternatively, certain balloons may be designated to aggregate state information for a given portion of the network. These balloons may then coordinate with one another to determine the overall state of the network.

Further, in some aspects, control of a balloon network may be partially or entirely localized, such that it is not dependent on the overall state of the network. For example, individual balloons may implement station-keeping functions that only consider nearby balloons. In particular, each balloon may implement an energy function that takes into account its own state and the states of nearby balloons. The energy function may be used to maintain and/or move to a desired position with respect to the nearby balloons, without necessarily considering the desired topology of the network as a whole. However, when each balloon implements such an energy function for station-keeping, the balloon network as a whole may maintain and/or move towards the desired topology.

As an example, each balloon A may receive distance information $d_1$ to $d_k$ with respect to each of its k closest neighbors. Each balloon A may treat the distance to each of the k balloons as a virtual spring with vector representing a force direction from the first nearest neighbor balloon i toward balloon A and with force magnitude proportional to $d_i$. The balloon A may sum each of the k vectors and the summed vector is the vector of desired movement for balloon A. Balloon A may attempt to achieve the desired movement by controlling its altitude.

Alternatively, this process could assign the force magnitude of each of these virtual forces equal to $d_i \times d_I$, wherein $d_I$ is proportional to the distance to the second nearest neighbor balloon, for instance.

In another embodiment, a similar process could be carried out for each of the k balloons and each balloon could transmit its planned movement vector to its local neighbors. Further rounds of refinement to each balloon's planned movement vector can be made based on the corresponding planned movement vectors of its neighbors. It will be evident to those skilled in the art that other algorithms could be implemented in a balloon network in an effort to maintain a set of balloon spacings and/or a specific network capacity level over a given geographic location.

2d) Example Balloon Configuration

Figure 3:
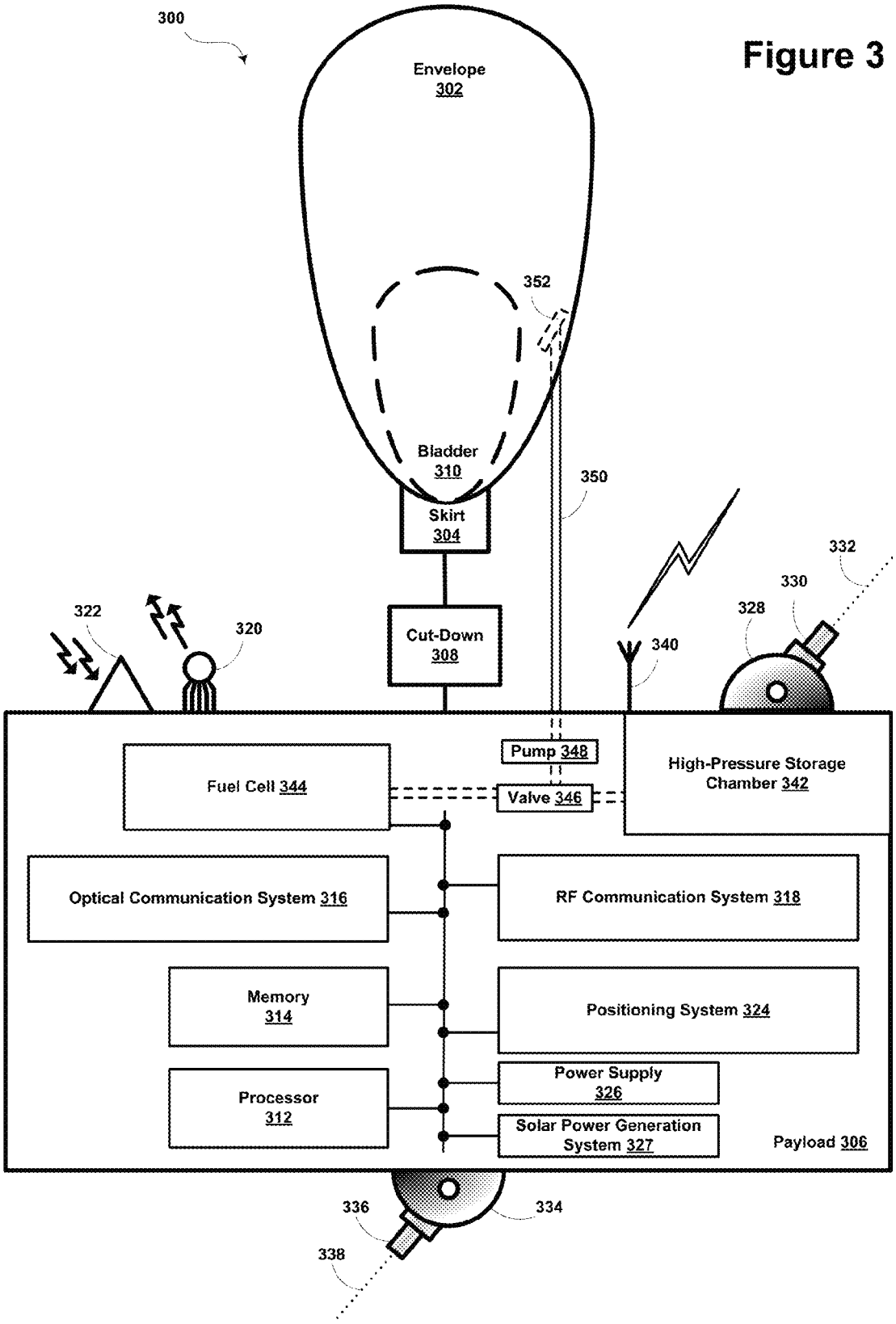
FIG. 3 is a simplified diagram illustrating a high-altitude balloon, according to an example embodiment.

Various types of balloon systems may be incorporated in an example balloon network. As noted above, an example embodiment may utilize high-altitude balloons, which could typically operate in an altitude range between 17 km and 25 km. FIG. 3 shows a high-altitude balloon 300, according to an example embodiment. As shown, the balloon 300 includes an envelope 302, a skirt 304, a payload 306, and a cut-down system 308, which is attached between the balloon 302 and payload 304.

The envelope 302 and skirt 304 may take various forms, which may be currently well-known or yet to be developed. For instance, the envelope 302 and/or skirt 304 may be made of a highly-flexible latex material or may be made of a rubber material such as chloroprene. In one example embodiment, the envelope and/or skirt could be made of metalized Mylar or BoPet. Other materials are also possible. Further, the shape and size of the envelope 302 and skirt 304 may vary depending upon the particular implementation. Additionally, the envelope 302 may be filled with various different types of gases, such as helium and/or hydrogen. Other types of gases are possible as well.

The payload 306 of balloon 300 may include a processor 312 and on-board data storage, such as memory 314. The memory 314 may take the form of or include a non-transitory computer-readable medium. The non-transitory computer-readable medium may have instructions stored thereon, which can be accessed and executed by the processor 312 in order to carry out the balloon functions described herein.

The payload 306 of balloon 300 may also include various other types of equipment and systems to provide a number of different functions. For example, payload 306 may include optical communication system 316, which may transmit optical signals via an ultra-bright LED system 320, and which may receive optical signals via an optical-communication receiver 322 (e.g., a photodiode receiver system). Further, payload 306 may include an RF communication system 318, which may transmit and/or receive RF communications via an antenna system 340.

The payload 306 may also include a power supply 326 to supply power to the various components of balloon 300. The power supply 326 could include a rechargeable battery. In other embodiments, the power supply 326 may additionally or alternatively represent other means known in the art for producing power. In addition, the balloon 300 may include a solar power generation system 327. The solar power generation system 327 may include solar panels and could be used to generate power that charges and/or is distributed by power supply 326.

Further, payload 306 may include various types of other systems and sensors 328. For example, payload 306 may include one or more video and/or still cameras, a GPS system, various motion sensors (e.g., accelerometers, magnetometers, gyroscopes, and/or compasses), and/or various sensors for capturing environmental data. Further, some or all of the components within payload 306 may be implemented in a radiosonde or other probe, which may be operable to measure, e.g., pressure, altitude, geographical position (latitude and longitude), temperature, relative humidity, and/or wind speed and/or wind direction, among other information.

As noted, balloon 300 includes an ultra-bright LED system 320 for free-space optical communication with other balloons. As such, optical communication system 316 may be configured to transmit a free-space optical signal by modulating the ultra-bright LED system 320. The optical communication system 316 may be implemented with mechanical systems and/or with hardware, firmware, and/or software. Generally, the manner in which an optical communication system is implemented may vary, depending upon the particular application. The optical communication system 316 and other associated components are described in further detail below.

In a further aspect, balloon 300 may be configured for altitude control. For instance, balloon 300 may include a variable buoyancy system, which is configured to change the altitude of the balloon 300 by adjusting the volume and/or density of the gas in the balloon 300. A variable buoyancy system may take various forms, and may generally be any system that can change the volume and/or density of gas in the envelope 302.

In an example embodiment, a variable buoyancy system may include a bladder 310 that is located inside of envelope 302. The bladder 310 could be an elastic chamber configured to hold liquid and/or gas. Alternatively, the bladder 310 need not be inside the envelope 302. For instance, the bladder 310 could be a ridged bladder that could be pressurized well beyond neutral pressure. The buoyancy of the balloon 300 may therefore be adjusted by changing the density and/or volume of the gas in bladder 310. To change the density in bladder 310, balloon 300 may be configured with systems and/or mechanisms for heating and/or cooling the gas in bladder 310. Further, to change the volume, balloon 300 may include pumps or other features for adding gas to and/or removing gas from bladder 310. Additionally or alternatively, to change the volume of bladder 310, balloon 300 may include release valves or other features that are controllable to allow gas to escape from bladder 310. Multiple bladders 310 could be implemented within the scope of this disclosure. For instance, multiple bladders could be used to improve balloon stability.

In an example embodiment, the envelope 302 could be filled with helium, hydrogen or other lighter-than-air material. The envelope 302 could thus have an associated upward buoyancy force. In such an embodiment, air in the bladder 310 could be considered a ballast tank that may have an associated downward ballast force. In another example embodiment, the amount of air in the bladder 310 could be changed by pumping air (e.g., with an air compressor) into and out of the bladder 310. By adjusting the amount of air in the bladder 310, the ballast force may be controlled. In some embodiments, the ballast force may be used, in part, to counteract the buoyancy force and/or to provide altitude stability.

In another embodiment, a portion of the envelope 302 could be a first color (e.g., black) and/or a first material from the rest of envelope 302, which may have a second color (e.g., white) and/or a second material. For instance, the first color and/or first material could be configured to absorb a relatively larger amount of solar energy than the second color and/or second material. Thus, rotating the balloon such that the first material is facing the sun may act to heat the envelope 302 as well as the gas inside the envelope 302. In this way, the buoyancy force of the envelope 302 may increase. By rotating the balloon such that the second material is facing the sun, the temperature of gas inside the envelope 302 may decrease. Accordingly, the buoyancy force may decrease. In this manner, the buoyancy force of the balloon could be adjusted by changing the temperature/volume of gas inside the envelope 302 using solar energy. In such embodiments, it is possible that a bladder 310 may not be a necessary element of balloon 300. Thus, various contemplated embodiments, altitude control of balloon 300 could be achieved, at least in part, by adjusting the rotation of the balloon with respect to the sun.

Further, a balloon 306 may include a navigation system (not shown). The navigation system may implement station-keeping functions to maintain position within and/or move to a position in accordance with a desired topology. In particular, the navigation system may use altitudinal wind data to determine altitudinal adjustments that result in the wind carrying the balloon in a desired direction and/or to a desired location. The altitude-control system may then make adjustments to the density of the balloon chamber in order to effectuate the determined altitudinal adjustments and cause the balloon to move laterally to the desired direction and/or to the desired location. Alternatively, the altitudinal adjustments may be computed by a ground-based or satellite-based control system and communicated to the high-altitude balloon. In other embodiments, specific balloons in a heterogeneous balloon network may be configured to compute altitudinal adjustments for other balloons and transmit the adjustment commands to those other balloons.

As shown, the balloon 300 also includes a cut-down system 308. The cut-down system 308 may be activated to separate the payload 306 from the rest of balloon 300. The cut-down system 308 could include at least a connector, such as a balloon cord, connecting the payload 306 to the envelope 302 and a means for severing the connector (e.g., a shearing mechanism or an explosive bolt). In an example embodiment, the balloon cord, which may be nylon, is wrapped with a nichrome wire. A current could be passed through the nichrome wire to heat it and melt the cord, cutting the payload 306 away from the envelope 302.

The cut-down functionality may be utilized anytime the payload needs to be accessed on the ground, such as when it is time to remove balloon 300 from a balloon network, when maintenance is due on systems within payload 306, and/or when power supply 326 needs to be recharged or replaced.

In an alternative arrangement, a balloon may not include a cut-down system. In such an arrangement, the navigation system may be operable to navigate the balloon to a landing location, in the event the balloon needs to be removed from the network and/or accessed on the ground. Further, it is possible that a balloon may be self-sustaining, such that it does not need to be accessed on the ground. In other embodiments, in-flight balloons may be serviced by specific service balloons or another type of aerostat or aircraft.

In a further aspect, balloon 300 includes a gas-flow system, which may be used for altitude control. In the illustrated example, the gas-flow system includes a high-pressure storage chamber 342, a gas-flow tube 350, and a pump 348, which may be used to pump gas out of the envelope 302, through the gas-flow tube 350, and into the high-pressure storage chamber 342. As such, balloon 300 may be configured to decrease its altitude by pumping gas out of envelope 302 and into high-pressure storage chamber 342. Further, balloon 300 may be configured to move gas into the envelope and increase its altitude by opening a valve 352 at the end of gas-flow tube 350, and allowing lighter-than-air gas from high-pressure storage chamber 342 to flow into envelope 302.

Note that the high-pressure storage chamber 342, in an example balloon, may be constructed such that its volume does not change due to, e.g., the high forces and/or torques resulting from gas that is compressed within the chamber. In an example embodiment, the high-pressure storage chamber 342 may be made of a material with a high tensile-strength to weight ratio, such as titanium or a composite made of spun carbon fiber and epoxy. However, high-pressure storage chamber 342 may be made of other materials or combinations of materials, without departing from the scope of the invention.

In a further aspect, balloon 300 may be configured to generate power from gas flow out of high-pressure storage chamber 342 and into envelope 302. For example, a turbine (not shown) may be fitted in the path of the gas flow (e.g., at the end of gas-flow tube 350). The turbine may be a gas turbine generator, or may take other forms. Such a turbine may generate power when gas flows from high-pressure storage chamber 342 to envelope 302. The generated power may be immediately used to operate the balloon and/or may be used to recharge the balloon's battery.

In a further aspect, a turbine, such as a gas turbine generator, may also be configured to operate "in reverse" in order to pump gas into and pressurize the high-pressure storage chamber 342. In such an embodiment, pump 348 may be unnecessary. However, an embodiment with a turbine could also include a pump.

In some embodiments, pump 348 may be a positive displacement pump, which is operable to pump gas out of the envelope 302 and into high-pressure storage chamber 342. Further, a positive-displacement pump may be operable in reverse to function as a generator.

Further, in the illustrated example, the gas-flow system includes a valve 346, which is configured to adjust the gas-flow path between envelope 302, high-pressure storage chamber 342, and fuel cell 344. In particular, valve 346 may adjust the gas-flow path such that gas can flow between high-pressure storage chamber 342 and envelope 302, and shut off the path to fuel cell 344. Alternatively, valve 346 may shut off the path high-pressure storage chamber 342, and create a gas-flow path such that gas can flow between fuel cell 344 and envelope 302.

Balloon 300 may be configured to operate fuel cell 344 in order to produce power via the chemical reaction of hydrogen and oxygen to produce water, and to operate fuel cell 344 in reverse so as to create hydrogen and oxygen from water. Accordingly, to increase its altitude, balloon 300 may run fuel cell 344 in reverse so as to generate gas (e.g., hydrogen gas), which can then be moved into the envelope to increase buoyancy. Specifically, balloon may increase its altitude by running fuel cell 344 in reverse, adjusting valve 346 and valve 352 such that hydrogen gas produced by fuel cell 344 can flow from fuel cell 344, through gas-flow tube 350, and into envelope 302.

To run fuel cell 344 "in reverse," balloon 300 may utilize an electrolysis mechanism in order to separate water molecules. For example, a balloon may be configured to use a photocatalytic water splitting technique to produce hydrogen and oxygen from water. Other techniques for electrolysis are also possible.

Further, balloon 300 may be configured to separate the oxygen and hydrogen produced via electrolysis. To do so, the fuel cell 344 and/or another balloon component may include an anode and cathode that attract the positively and negatively charged O− and H− ions, and separate the two gases. Once the gases are separated, the hydrogen may be directed into the envelope. Additionally or alternatively, the hydrogen and/or oxygen may be moved into the high-pressure storage chamber.

Further, to decrease its altitude, balloon 300 may use pump 348 to pump gas from envelope 302 to the fuel cell 344, so that the hydrogen gas can be consumed in the fuel cell's chemical reaction to produce power (e.g., the chemical reaction of hydrogen and oxygen to create water). By consuming the hydrogen gas the buoyancy of the balloon may be reduced, which in turn may decrease the altitude of the balloon.

It should be understood that variations on the illustrated high-pressure storage chamber are possible. For example, the high-pressure storage chamber may take on various sizes and/or shapes, and be constructed from various materials, depending upon the implementation. Further, while high-pressure storage chamber 342 is shown as part of payload 306, high-pressure storage chamber could also be located inside of envelope 302. Yet further, a balloon could implement multiple high-pressure storage chambers. Other variations on the illustrated high-pressure storage chamber 342 are also possible.

It should also be understood that variations on the illustrated air-flow tube 350 are possible. Specifically, any configuration that facilitates movement of gas between the high-pressure storage chamber and the envelope is possible.

Yet further, it should be understood that a balloon and/or components thereof may vary from the illustrated balloon 300. For example, some or all of the components of balloon 300 may be omitted. Components of balloon 300 could also be combined. Further, a balloon may include additional components in addition or in the alternative to the illustrated components of balloon 300. Other variations are also possible.

3. Balloon Network with Optical and RF Links Between Balloons

In some embodiments, a high-altitude-balloon network may include super-node balloons, which communicate with one another via optical links, as well as sub-node balloons, which communicate with super-node balloons via RF links. Generally, the optical links between super-node balloons may be configured to have more bandwidth than the RF links between super-node and sub-node balloons. As such, the super-node balloons may function as the backbone of the balloon network, while the sub-nodes may provide sub-networks providing access to the balloon network and/or connecting the balloon network to other networks.

Figure 4:
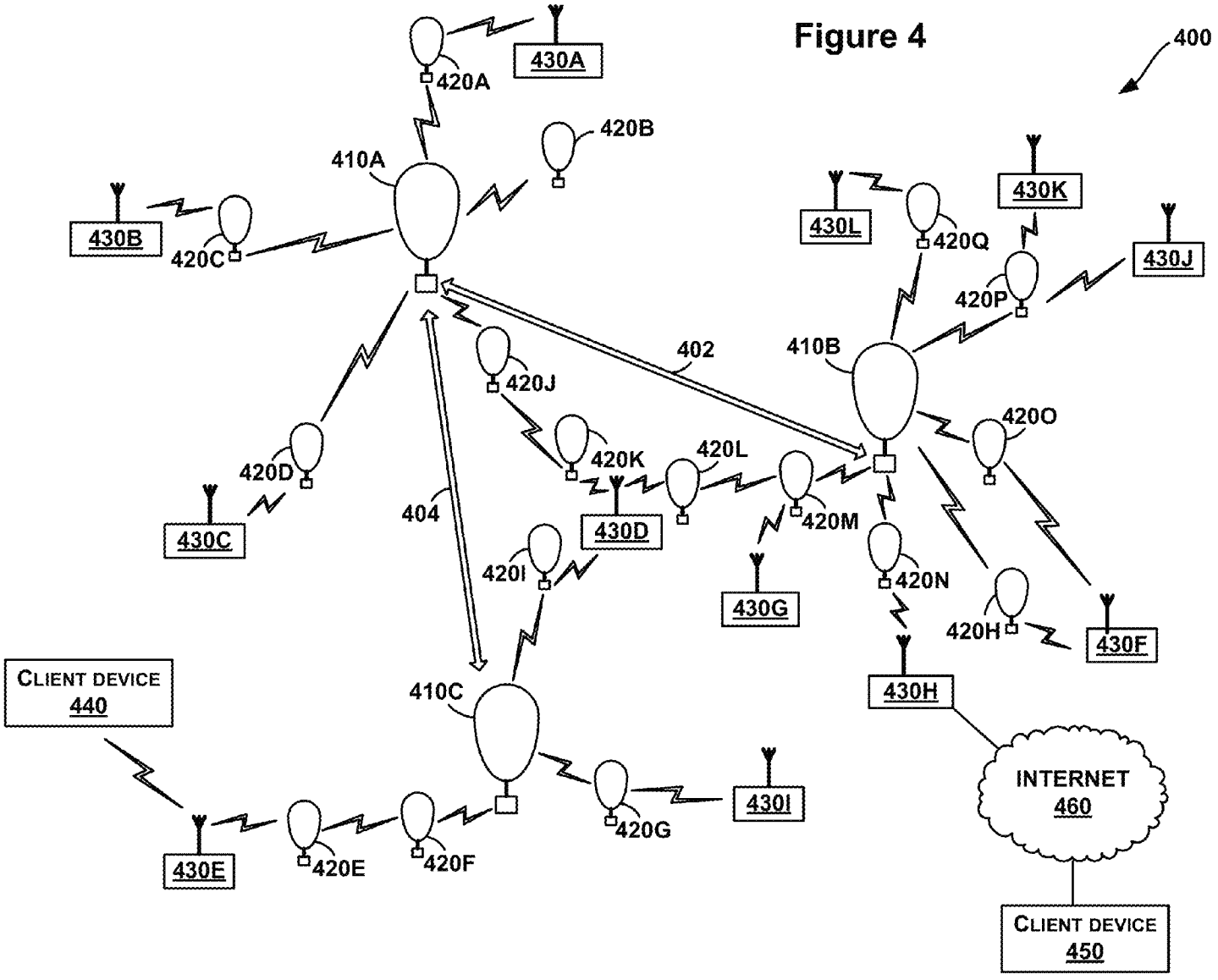
FIG. 4 is a simplified diagram illustrating a balloon network that includes super-nodes and sub-nodes, according to an example embodiment.

FIG. 4 is a simplified diagram illustrating a balloon network that includes super-nodes and sub-nodes, according to an example embodiment. More specifically, FIG. 4 illustrates a portion of a balloon network 400 that includes super-node balloons 410A to 410C (which may also be referred to as "super-nodes") and sub-node balloons 420 (which may also be referred to as "sub-nodes").

Each super-node balloon 410A to 410C may include a free-space optical communication system that is operable for packet-data communication with other super-node balloons. As such, super-nodes may communicate with one another over optical links. For example, in the illustrated embodiment, super-node 410A and super-node 401B may communicate with one another over optical link 402, and super-node 410A and super-node 401C may communicate with one another over optical link 404.

Each of the sub-node balloons 420 may include a radio-frequency (RF) communication system that is operable for packet-data communication over one or more RF air interfaces. Accordingly, each super-node balloon 410A to 410C may include an RF communication system that is operable to route packet data to one or more nearby sub-node balloons 420. When a sub-node 420 receives packet data from a super-node 410, the sub-node 420 may use its RF communication system to route the packet data to a ground-based station 430 via an RF air interface.

As noted above, the super-nodes 410A to 410C may be configured for both longer-range optical communication with other super-nodes and shorter-range RF communications with nearby sub-nodes 420. For example, super-nodes 410A to 410C may use using high-power or ultra-bright LEDs to transmit optical signals over optical links 402, 404, which may extend for as much as 100 miles, or possibly more. Configured as such, the super-nodes 410A to 410C may be capable of optical communications at speeds of 10 to 50 GB/sec or more.

A larger number of balloons may be configured as sub-nodes, which may communicate with ground-based Internet nodes at speeds on the order of approximately 10 MB/sec. Configured as such, the sub-nodes 420 may be configured to connect the super-nodes 410 to other networks and/or to client devices.

Note that the data speeds and link distances described in the above example and elsewhere herein are provided for illustrative purposes and should not be considered limiting; other data speeds and link distances are possible.

In some embodiments, the super-nodes 410A to 410C may function as a core network, while the sub-nodes 420 function as one or more access networks to the core network. In such an embodiment, some or all of the sub-nodes 420 may also function as gateways to the balloon network 400. Additionally or alternatively, some or all of ground-based stations 430 may function as gateways to the balloon network 400.

4. Example Passive Antenna Steering Systems

Figure 5A:
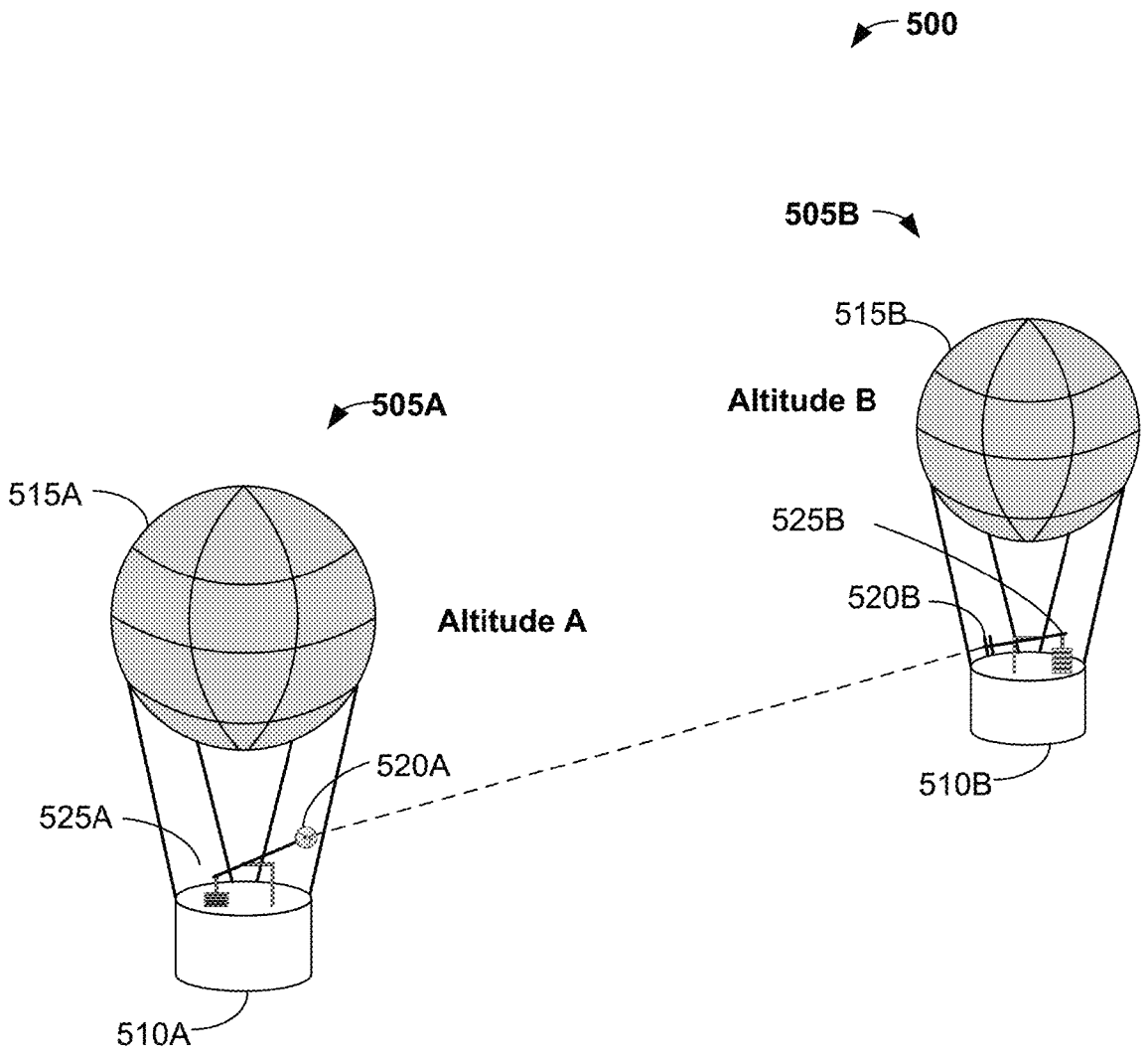
FIG. 5A shows a first high-altitude balloon in communication with a second high-altitude balloon, as part of a balloon network, according to an example embodiment.

FIG. 5A shows a first high-altitude balloon 505A in communication with a second high-altitude balloon 505B, as part of balloon network 500, in accordance with an example embodiment. Balloons 505A,B can be the same as or differ from balloon 300 described above in the context of FIG. 3. In embodiments not shown in the Figures, balloon 300 can include some or all of the components of balloons 505A,B described that are not shown as components of balloon 300 in FIG. 3. Each balloon 505A,B can include a payload 510A,B, an envelope 515A,B, an antenna 520A,B, a pressure-sensitive mechanism 525A-G and a calibration system (not shown). The passive antenna steering system can include the pressure-sensitive mechanism alone or in combination with the calibration system.

FIGS. 5B-G show example arrangements of the antenna transmitter 520B or the antenna receiver 520A, respectively, and the pressure-sensitive mechanism 525A-G, according to example embodiments of the passive antenna steering system shown in FIG. 5A. In one example embodiment, the antenna 520A,B defines a base end 521A,B and a signalling end 522A,B. The signalling end 522A,B of the antenna can be a transmitter 520B, a receiver 520A, or a transceiver. In another example embodiment, shown in FIGS. 5D-G, the antenna 520D-G can include two or more radiating elements 518D-G, typically provided as an array of radiating elements. In a further embodiment, the antenna includes a reflector 519D-G arranged such that the two or more radiating elements are situated over the reflector. The reflector 519D-G may be a dish, such as a quasi-parabolic dish that may be spherically invariant. Here, the antenna's base end 521D-G is on the rear face of the reflector 519D-G and the signalling end 522D-G comprises the front face of the reflector 519D-G and the radiating element 518D-G. The radiating element 518D-G emits signals toward the reflector 519D-G, which results in radiation emitted from the antenna 520D-G with an emission pattern that is determined, at least in part, by the separation distance between the radiating element 518D-G and the reflector 519D-G. Generally, a greater separation distance corresponds to a narrower beam width, whereas a lesser separation distance corresponds to a broader beam width.

In some examples, the width of the emission pattern (i.e., the transmitted signal beam) can be adjusted as the balloon 505A changes altitude, such that the width of the signal beam received by a ground station in the network or a user on the ground remains substantially the same. For example, the radiating element 518D-G in the antenna 520D-G can be moved closer or further from the reflector 519D-G to dynamically adjust the width of the emission pattern based on the altitude of the balloon 505A. In one embodiment, a pressure-sensitive mechanism 525D-G expands and contracts in response to changes in the ambient pressure as the balloon changes altitude can be used to passively adjust the separation distance as the altitude varies. In the embodiment in which a Bourdon tube is used, the expansion and contraction are reflected by changes in the bend radius of the tube. In the same or a different embodiment, shown for example in FIGS. 5D and 5F, the antenna's downtilt/uptilt angle may be modified through the same or a different pressure-sensitive mechanism 525D-G acting upon the reflector 519D, F. As used herein, downtilt/uptilt angle refers to a conical perturbation of the beam pattern as opposed to an overall rotation of a flat "pancake" pattern. In the embodiment in which both the downtilt/uptilt angle and the separation distance from the reflector to the radiating element are adjusted by a pressure-sensitive mechanism, the reflector 519D-G defines a slot (not shown) where the radiating element 518D-G is coupled to the pressure-sensitive mechanism 525D-G or an intermediate linkage to allow the reflector 519D-G to rotate.

The antenna 520A-G is preferably a high gain antenna with a narrow beam width ranging from about 1 degree to about 30 degrees. The antenna beam width is calculated to accommodate communication with each neighboring balloon in the network. These neighboring balloons may be located at any altitude within the navigation altitude range. In general, the antenna's rotational range and beam width should be approximately equal. In one example embodiment, a beam width and rotational range may each be about 10 degrees, which is half of the beam width utilized by fixed antennas. This allows a first balloon to communicate with neighbors at the top of the altitude range, when the first balloon is at the bottom of the altitude range, and vice versa. In a preferred embodiment, the maximum range of antenna rotation is from 0° up to and including 20°. In one embodiment, the contemplated range of antenna rotation is a multiple of the beam width of the antenna with the distance between balloon 505A and 505B, which is typically 10-20 Km. An antenna pivot 523A,B is disposed at some point on the antenna 525A,B between the signalling end 522A,B and the base end 521A,B. In an alternative embodiment shown in FIGS. 5D and 5F, the antenna pivot 523D,F is disposed on the back side of the reflector 519D,F opposite the radiating element 518D,F. In the embodiment of Figures A-C, the antenna pivot 523A,B is mounted on an upright rigid support structure 530A,B that can take any form. By way of example only, the antenna pivot 523A,B may be mounted on the side of an L-shaped 530A,B, a U-Shaped, or an upside down V-shaped structure. Alternatively, the antenna pivot 523A,B may be mounted in between the prongs of a Y-shaped rigid support structure or in between any other two upright supports. In the embodiments shown, the antenna 520A,B is rotatably mounted on the payload 510A,B, but various other embodiments contemplate rotatably mounting the antenna 520A,B and passive antenna steering system on the envelope 515A,B.

As discussed in more detail below, the position of the antenna pivot 523A,B may be adjusted by the calibration system in some embodiments. In one embodiment, the rigid pivot support 530A,B is disposed on a movable support in the form of a platform 535A,B. The movable platform 535A,B interfaces with the calibration system to move the platform vertically up or down. As the platform moves 535A,B, the antenna pivot 523A,B slides along a slot (not shown) disposed axially within the antenna 520A,B to change the location of the antenna pivot 523A,B and therefore adjust the angle of the antenna 520A,B. This allows the aneroid's expansion and contraction to affect the antenna's angle of rotation in a more fine-tuned attenuated manner. As such, the system is calibrated so that antenna alignment can be maintained with antennas on other balloons at varying distances.

Figure 5B:
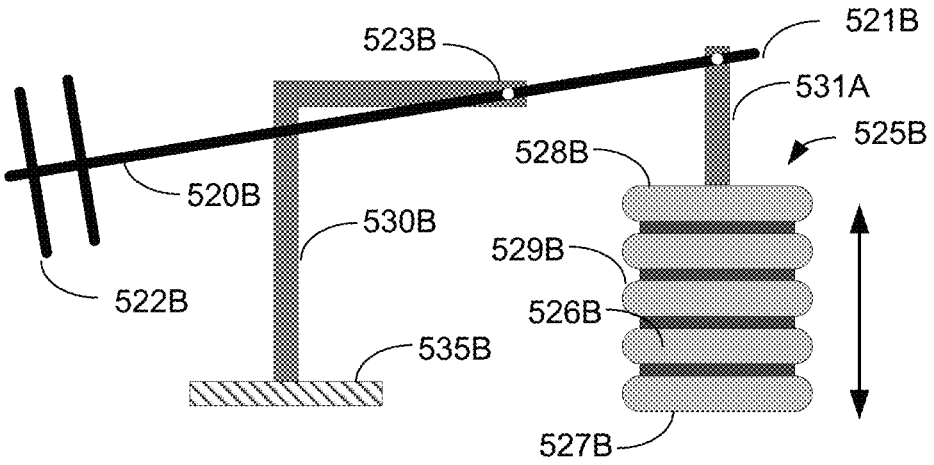
FIG. 5B shows an example arrangement of an antenna transmitter and an aneroid, according to an example embodiment.
Figure 5C:
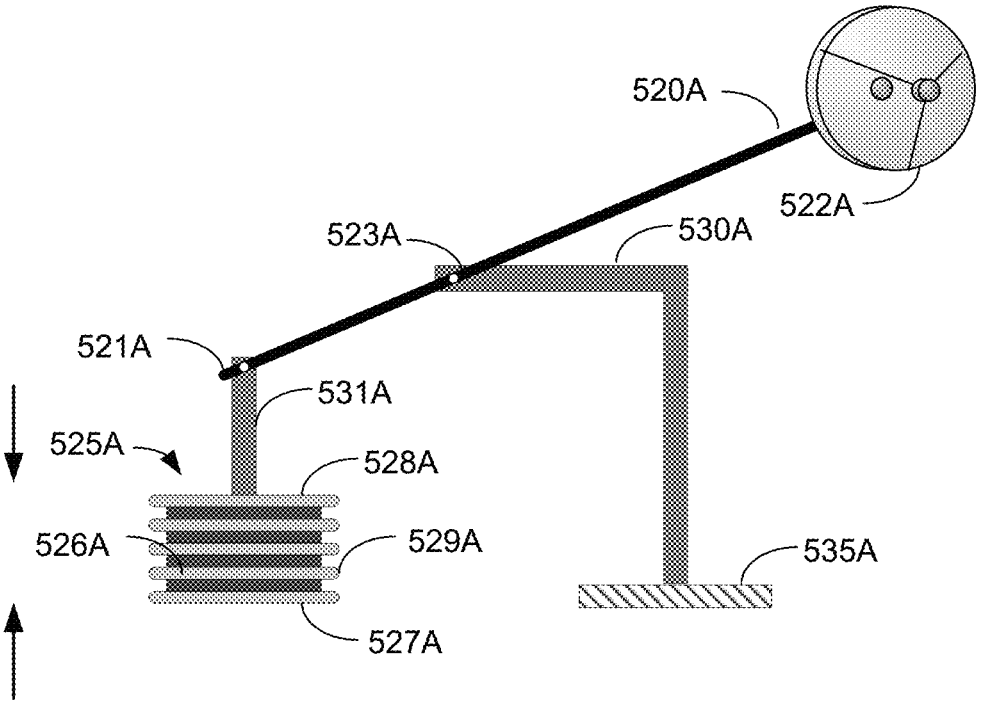
FIG. 5C shows an example arrangement of an antenna receiver and an aneroid, according to an example embodiment.
Figure 5D:
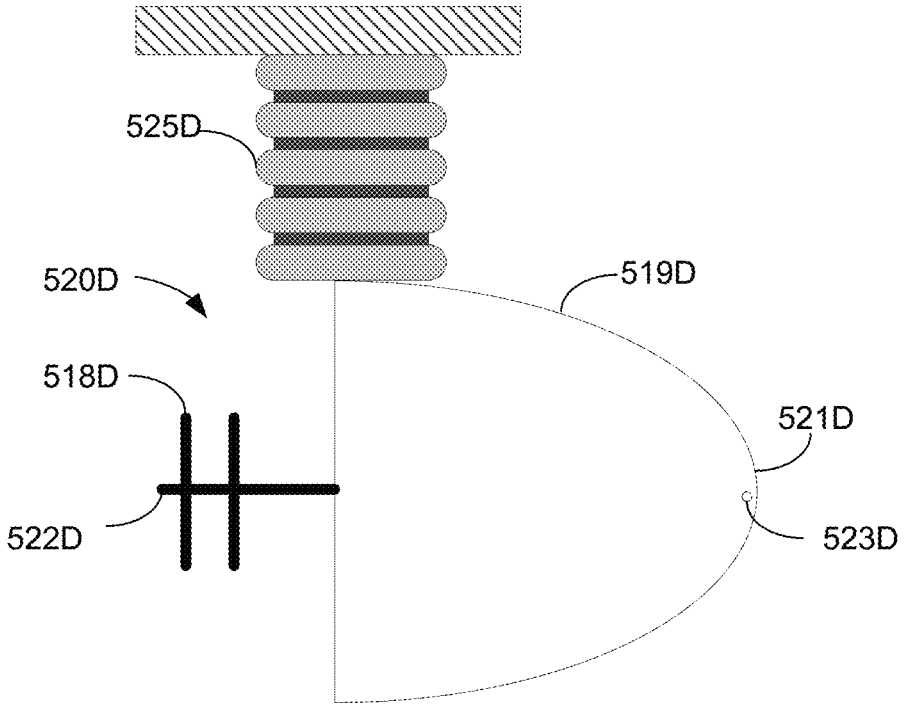
FIG. 5D shows an example arrangement of an antenna comprising a reflector and radiating element with an aneroid, according to an example embodiment.
Figure 5E:
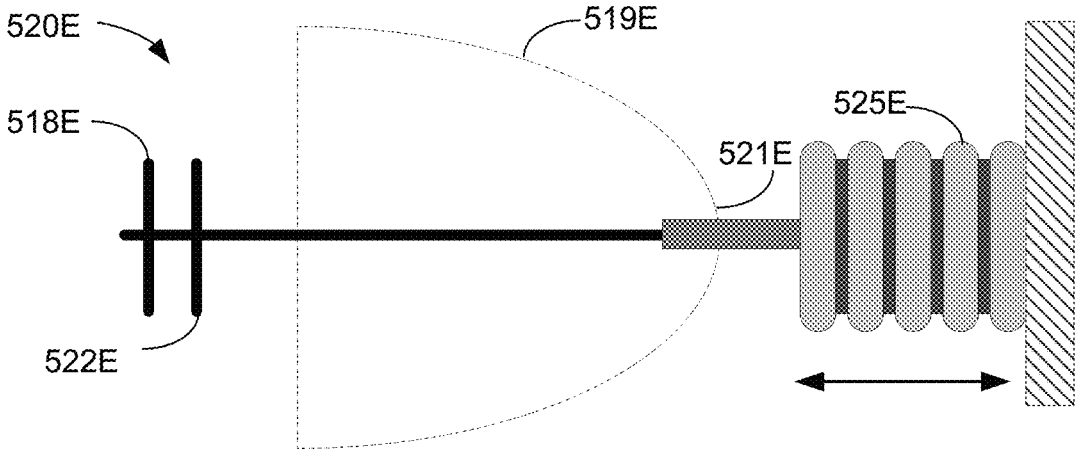
FIG. 5E shows an example arrangement of an antenna comprising a reflector and a radiating element in cross-section with an aneroid, according to an example embodiment.
Figure 5F:
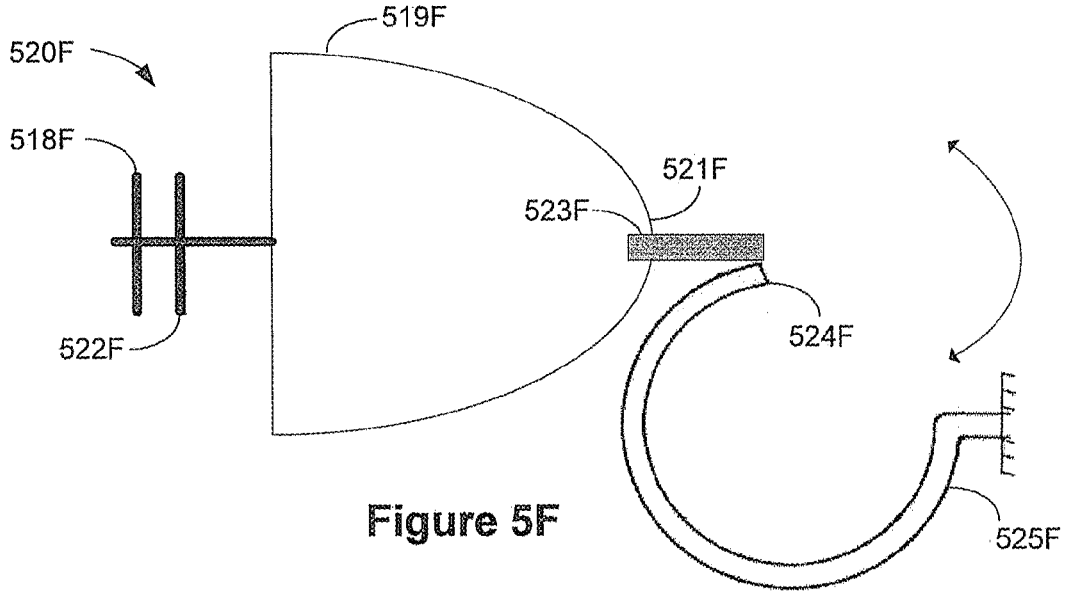
FIG. 5F shows an example arrangement of an antenna comprising a reflector and a radiating element with a Bourbon tube, according to an example embodiment.
Figure 5G:
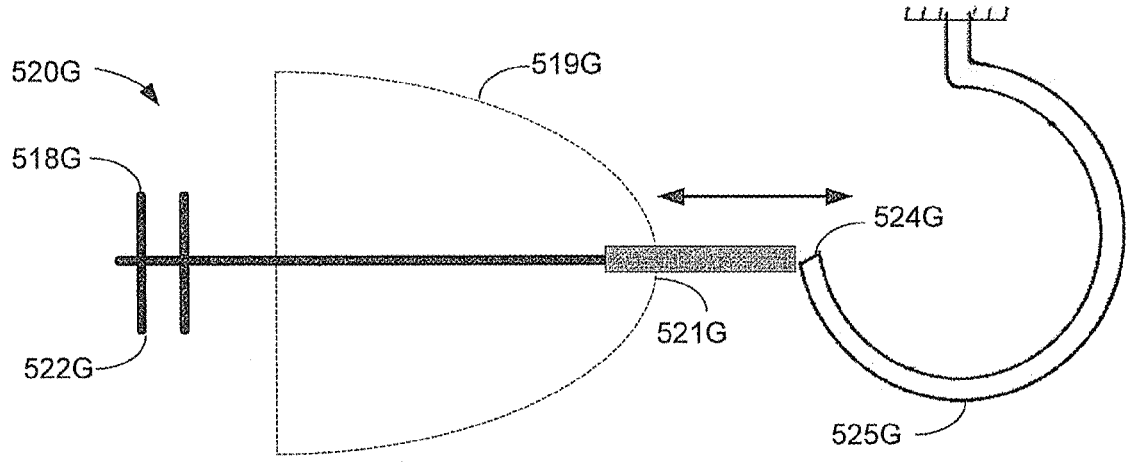
FIG. 5G shows an example arrangement of an antenna comprising a reflector and a radiating element in cross-section with a Bourbon tube, according to an example embodiment.

The pressure-sensitive mechanism 525 may comprise a Bourdon tube, an aneroid or a spring and piston, for example. A Bourdon tube is a thin-walled flattened tube of elastic metal bent into a circular arc or a helix. When the pressure inside the tube increases, the tube tends to straighten out or uncoil such that its bend radius changes. As shown in FIGS. 5F-G, as the ambient pressure decreases, the unrestrained end 524F,G moves substantially linearly in response to changes in the bend radius, and this motion is converted into the rotation of the antenna (FIG. 5F) and/or an adjustment in the spacing of the radiating element 518F,G relative to the reflector 519F,G (FIG. 5G).

An aneroid, on the other hand, comprises a chamber with at least one flexible surface capable of contraction or expansion. This surface may comprise a diaphragm or a collapsible sidewall, for example, that may be corrugated, pleated or comprise a pliable material. The chamber contains a partial vacuum so that the air remaining in the space exerts less pressure than the atmosphere. In operation, when the air pressure outside the chamber increases or decreases, the flexible surface allows the aneroid to contract or expand, respectively. In various embodiments, the flexible surface acts as a spring to prevent the aneroid from collapsing. As such, suitable materials for this flexible surface include stainless steel, brass, copper, Monel, and bronze. Other metals or plastics that maintain their spring rate with varied temperatures and multiple expansion and contraction cycles are also contemplated. In various embodiments, the aneroid may take the form of (a) a chamber with a bottom surface, a top surface and at least one collapsible sidewall, (b) a bellows (discussed below with respect to FIG. 7), (c) a capsule with a flexible diaphragm, and (d) or a stacked pile of pressure capsules with corrugated diaphragms. The foregoing list is not intended to be exhaustive and is provided merely by way of example.

The spring and piston works similar to the aneroid with collapsible sidewalls. In both cases a spring force is required to prevent the chamber with evacuated volume from collapsing under ambient atmospheric pressure. In the case of the aneroid, the sidewalls act as springs to provide the restoring force. In the case of a piston, a separate spring is utilized.

In one example embodiment, the pressure-sensitive mechanism comprises an aneroid 525A,B that is in mechanical communication with the antenna 520A,B such that the signalling end 522A,B of the antenna rotates upward as the aneroid 525A,B contracts and rotates downward as the aneroid 525A,B expands. In the present embodiment, the base end 521A,B of the antenna 520A,B is pivotally attached to the aneroid 525A,B via a support arm 531A,B. The aneroid 525A,B can define an enclosed chamber 526A,B with a first surface 527A,B, a second surface 528A,B and at least one collapsible sidewall 529A,B disposed between the first surface 527A,B and the second surface 528A,B. In this embodiment, the collapsible sidewall comprises the aneroid's flexible surface. The first surface 527A,B of the aneroid 525A,B can be fixedly mounted, while the second surface 528A,B of the aneroid 525A,B can be movable relative to the first surface 527A,B. In the example embodiment shown in FIGS. 5A-C, the second surface 528A,B of the aneroid is arranged relative to the first surface 527A,B of the aneroid 525A,B such that the second surface 528A,B moves along a shared axis with the first surface 527A,B. In this example arrangement, the aneroid 525A,B takes the form of a cylinder. The at least one collapsible sidewall 529A,B can be corrugated, pleated and/or comprise a pliable material.

In addition, the aneroid chamber 526A,B contains a partial vacuum that allows the aneroid 525A,B to expand and contract as balloons 505A,B change altitude. Specifically, in FIG. 5A, balloon 505B is at a higher altitude B with a lower air pressure than is present at a lower altitude A, where balloon 505A is stationed. The lower air pressure at altitude B allows the aneroid 525B to expand, angling the signalling end 522B of antenna downward, as shown in FIG. 5B. The higher air pressure at altitude A allows the aneroid 525A to contract, angling the signalling end 522A of antenna upward, as shown in FIG. 5C. In one example, if the transmitting balloon 505B moved to a lower altitude, the aneroid 525B would contract, and the transmitting antenna 520B would rotate upwards and the receiving antenna 520A could optionally be adjusted by the calibration system to maintain the communication link while the receiving balloon 505A maintains the same altitude A.

In an additional embodiment, the passive antenna steering system further includes a counterweight (not shown) in the form of a biasing spring. The biasing spring has a first end that is fixedly mounted above the aneroid 525 and a second end that is coupled to the movable second surface 528 of the aneroid 525. The purpose of the biasing spring is to offset the effect of the antenna's weight in the passive antenna steering system. In the absence of a counterweight, the antenna's weight can be taken into account by the calibration system's processor, discussed in more detail below.

Figure 6A:
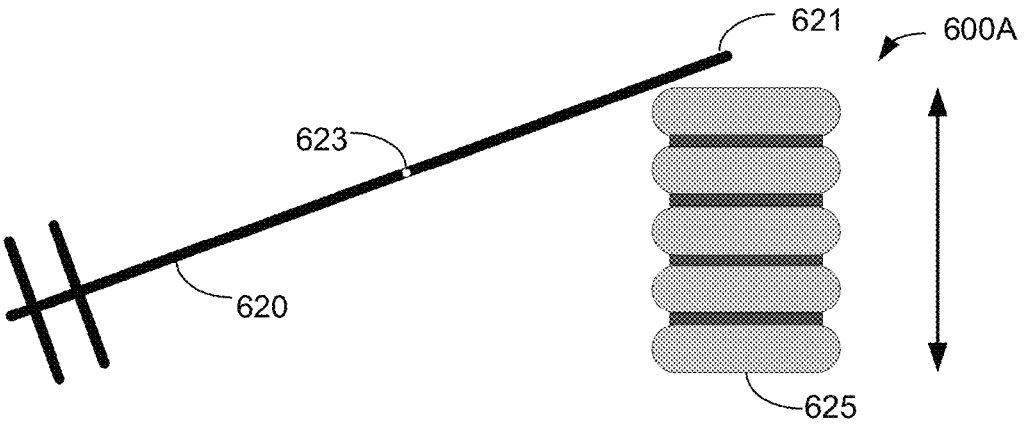
FIG. 6A shows an example arrangement of an antenna in mechanical communication with an aneroid in an expanded position.
Figure 6B:
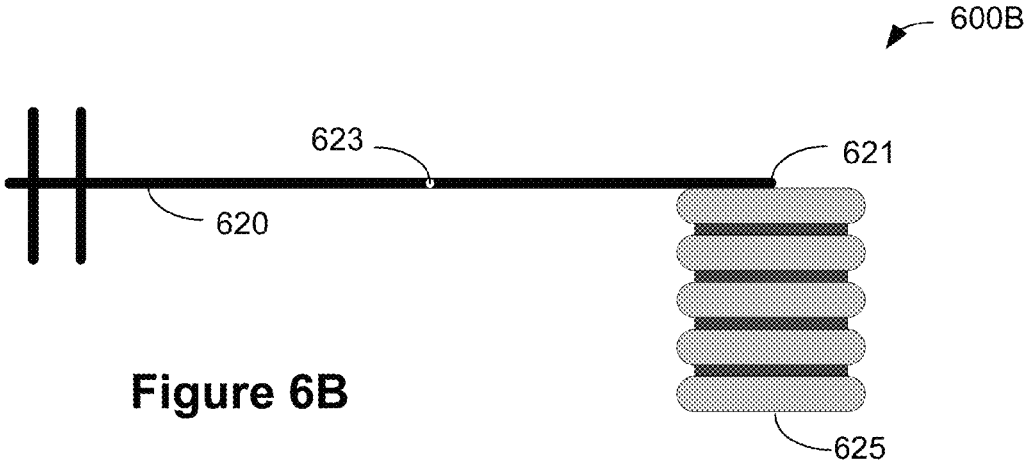
FIG. 6B shows an example arrangement of an antenna in mechanical communication with an aneroid in a neutral position.
Figure 6C:
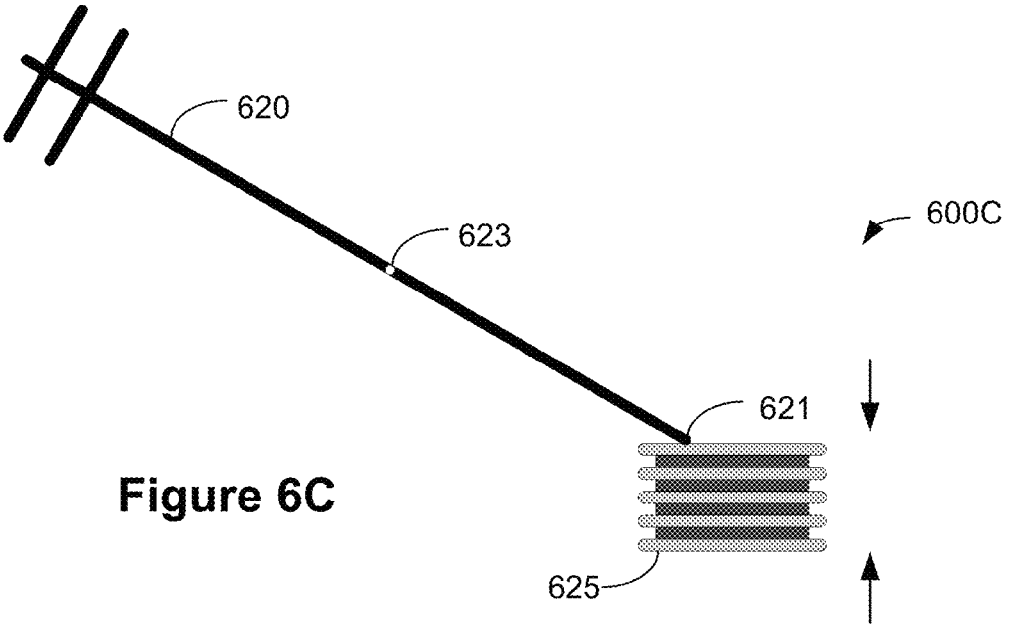
FIG. 6C shows an example arrangement of an antenna in mechanical communication with an aneroid in a contracted position

FIGS. 6A-C show an example arrangement of the passive antenna steering device in which the antenna 620 is in mechanical communication with the aneroid 625. FIG. 6A shows the aneroid 625 in an expanded condition 600A at high altitude, angling the antenna downward. FIG. 6B shows the aneroid at the anticipated operating altitude in a partially expanded condition placing the antenna in a neutral horizontal position 600B. FIG. 6C shows the aneroid 625 in a contracted condition 600C at a low altitude, angling the antenna 620 upward. In this embodiment, the base end 621 of the antenna is not mechanically connected per se to the aneroid 625, but instead slides across the second surface 628 of the aneroid as the atmospheric pressure changes. The antenna 620 is again rotatably mounted on a pivot 623 at some point along the antenna's length. The antenna pivot 623 can be mounted to any rigid structure as described above with respect to FIGS. 5A-C. This pivot 623 can likewise be disposed on the balloon's envelope or payload. In this embodiment, the aneroid 625 is in the form of an upright cylinder.

Figure 7:
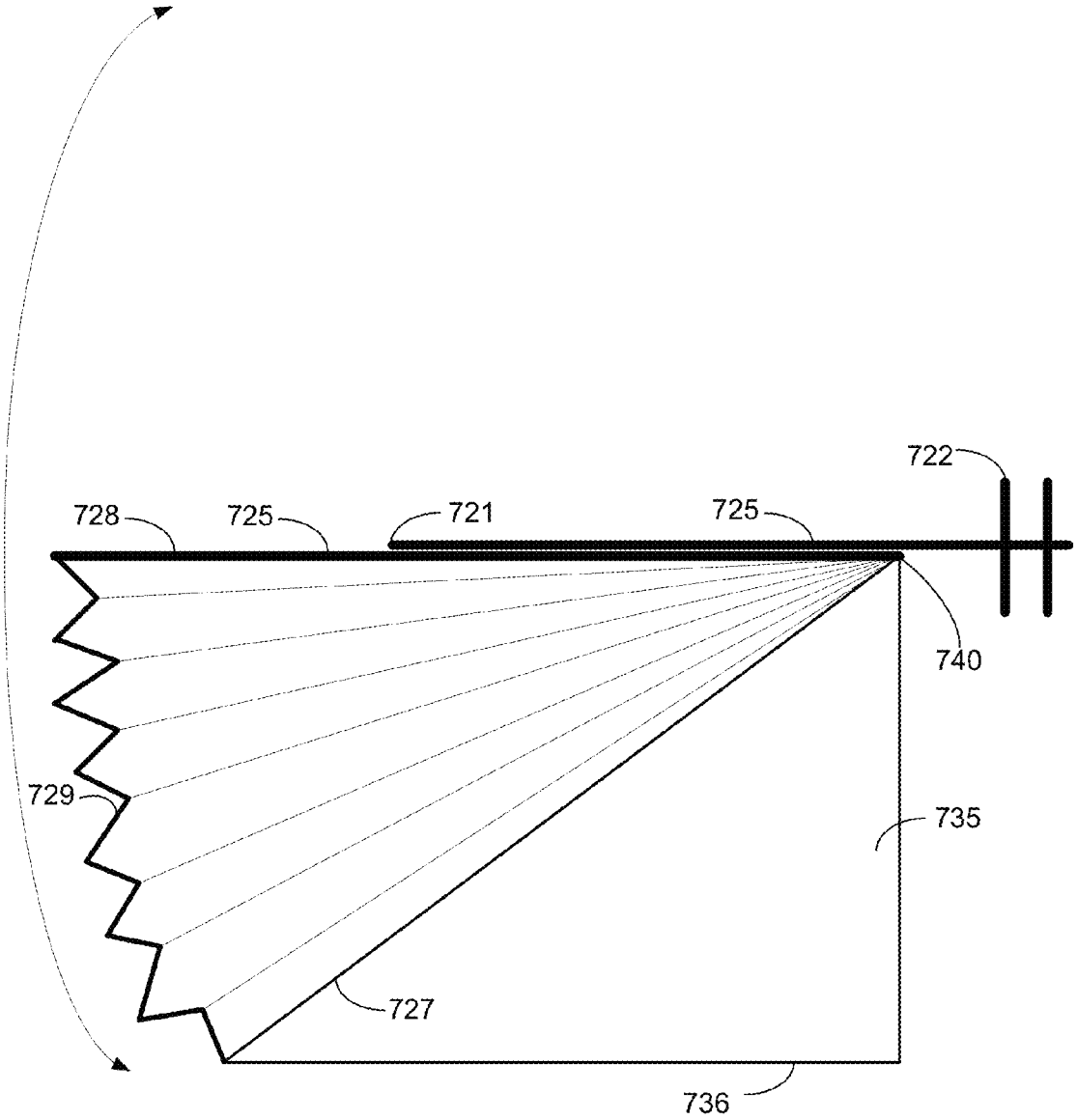
FIG. 7 shows an example arrangement of an antenna transmitter and an aneroid, according to an example embodiment.

FIG. 7 shows an example arrangement of an antenna transmitter 720 and an aneroid 726, according to another example embodiment. In this embodiment, the aneroid 725 can take the form of a wedge similar to a bellows with a collapsible sidewall 729. The base end 721 of the antenna 720 is statically mounted to the second surface 728 of the aneroid 725. The second surface 728 of the aneroid 725 is arranged to pivot relative to the first surface 277 of the aneroid 725. The first surface 727 of the aneroid 725 is disposed at an acute angle such that the non-pivoting edge 740 of the aneroid 725 is elevated. The non-pivoting edge 740 of the first surface 727 of the aneroid 725 is coupled to a movable support 735, which in this embodiment comprises a wedge-shaped mounting black.

In operation, as the aneroid 725 expands, the second surface 728 of the antenna 720 pivots upwards, angling the signalling end 722 of the antenna 720 downward. Likewise, as the aneroid 725 contracts, the second surface 728 of the antenna 720 pivots downwards, angling the signalling end 722 of the antenna 720 upward. As discussed in more detail below, the position of the non-pivoting edge 740 of the first surface 727 of the aneroid 725 may be adjusted by the calibration system in some embodiments. In the instant embodiment, the base 736 of the wedge-shaped mounting block 735 interfaces with the calibration system, which moves the non-pivoting edge 740 through an angle of rotation (both up or down) to adjust the angle of the antenna 720. In alternative embodiments, the movable support could further comprise a support arm hingedly attached to the non-pivoting edge 740. In operation, the movable support arm moves upward and the gap in between the hinges closes, or moves downward and gap in between the hinges widens This arrangement allows the non-pivoting edge 740 to move vertically without moving through an angle of rotation. The same results could be achieved with any other flexible attachment mechanism employed between the non-pivoting edge 740 and the movable support. In these embodiments, the first surface 727 of the aneroid 725 is considered "fixedly mounted" even though it is coupled to a movable support 735. The foregoing examples are intended to be non-limiting.

Figure 8:
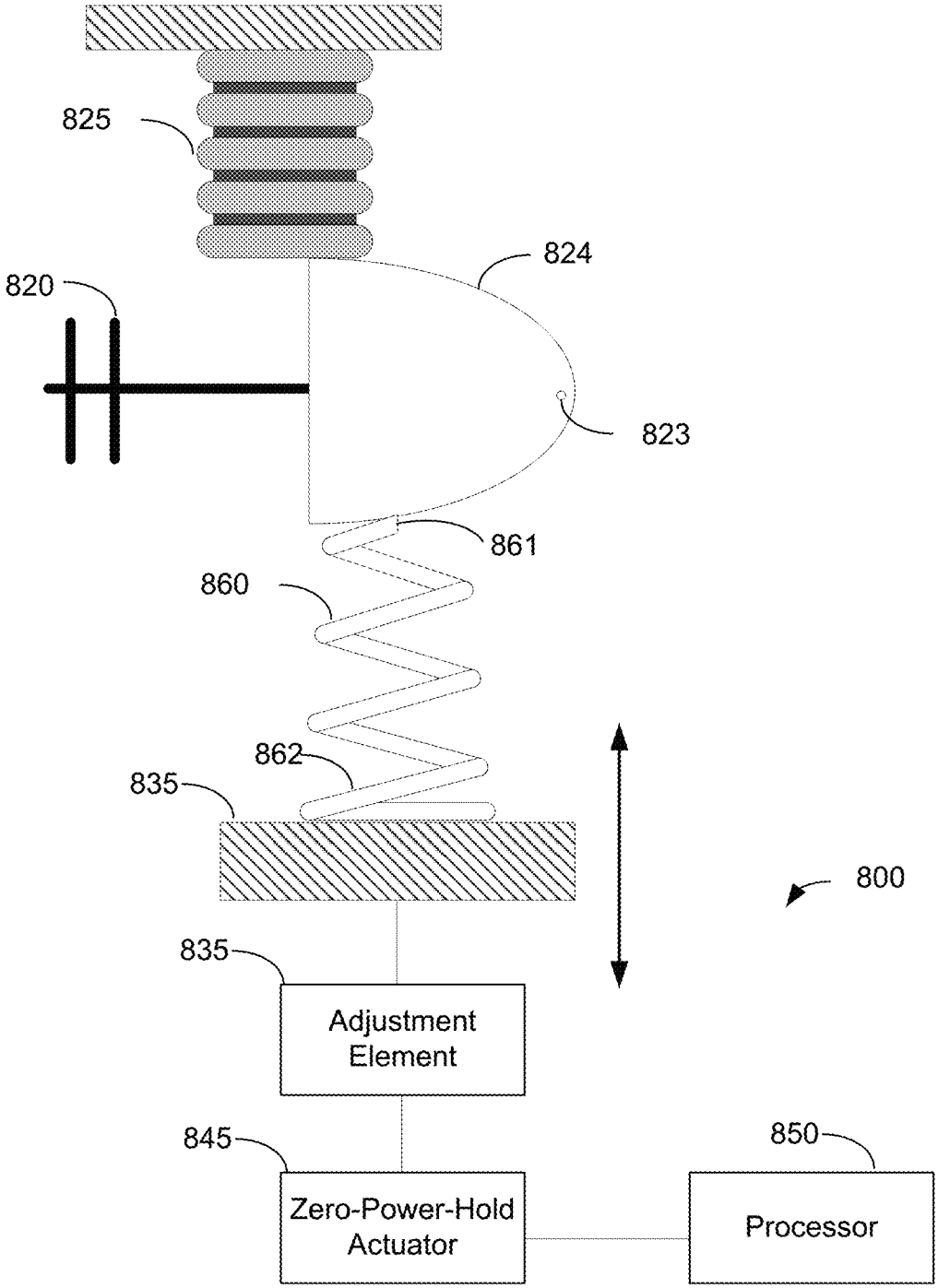
FIG. 8 shows an example arrangement of an antenna and calibration system, according to an example embodiment.

FIG. 8 shows an example arrangement of an antenna 820 and calibration system 800, according to an example embodiment. The calibration system 800 can include a zero-power-hold actuator 845 and a processor 850. The zero-power-hold actuator 845 can be in mechanical communication with the antenna 820 either directly or indirectly. The zero-power-hold actuator 845 is an actuator that operates with "zero" standby power. The zero-power-hold actuator 845 reorients the antenna 820 to calibrate the passive antenna steering system based on a signal from the processor 850. In response to a signal from the processor 850, electric "power" is supplied to the zero-power-hold actuator 845 for only a brief period of time to effect the calibration. The zero-power-hold actuator 845 then maintains a "holding" force in the calibration system 800, when electrical power ceases. Examples of a zero-power-hold actuator 845 include piezoelectric motors, servomotors, and solenoids. The processor 850 actuates the zero-power-hold actuator 845 when the processor receives an indication of a change in altitude, a change in latitude, a change in the distance to a second balloon in the network and/or a change in antenna signal beam width from a ground station, a second balloon, and/or an altimeter and, as a result, determines that the antenna 820 is not properly aligned with another antenna in the balloon network. The foregoing calibration may be useful because a change in one of the foregoing factors may affect the degree of antenna rotation or movement that is required to maintain alignment with another other antenna, e.g., in response to a simultaneous or subsequent aneroid expansion/contraction.

In some embodiments, the calibration system can further include a movable support 835. Depending on the arrangement of the antenna 820 and the aneroid 825, the zero-power-hold actuator 845 can act directly upon the movable support 835, the first surface 827 of the aneroid 825, or the antenna pivot 823. In other embodiments, the zero-power-hold actuator 845 can optionally be in mechanical communication with an adjustment element 855, such as a set screw or a magnet, which adjusts the position of the first surface 827 of the aneroid 825, the antenna pivot 823, or the movable support 835.

In the present embodiment, the base end 821 of antenna 820 is mounted to a domed mounting block 824 and the calibration system further includes a tension spring 860 with a first end 861 and a second end 862. Alternatively, the antenna may be configured as a reflector and a radiating element, as discussed in detail above, in which the aneroid and the tension spring act on the reflector in the same manner in which they act on the domed mounting block 824, as described below. The first end 861 of the spring 860 is coupled either directly or indirectly to the antenna 820 (here it is connected to the domed mounting block 824), and the second end 862 of the spring 860 is coupled to the movable support 835. The aneroid 825 is mounted directly over the domed mounting block 824 such that it expands in the direction of the antenna 820 acting upon the domed mounting block 824 and to angle the antenna 820 downward. The zero-power-hold actuator 845 induces tension in the spring 860 by raising the movable support 835 to lessen or counteract the impact of the aneroid 825, when the aneroid 825 is expanded, and reduces tension in the spring 860 by lowering the movable support 835 to lessen or counteract the impact of the aneroid 825, when the aneroid 825 is contracted. Accordingly, the passive antenna steering system calibrates the degree to which the aneroid's expansion and contraction can affect the angle of the antenna 820.

5. Illustrative Methods

Figure 9:
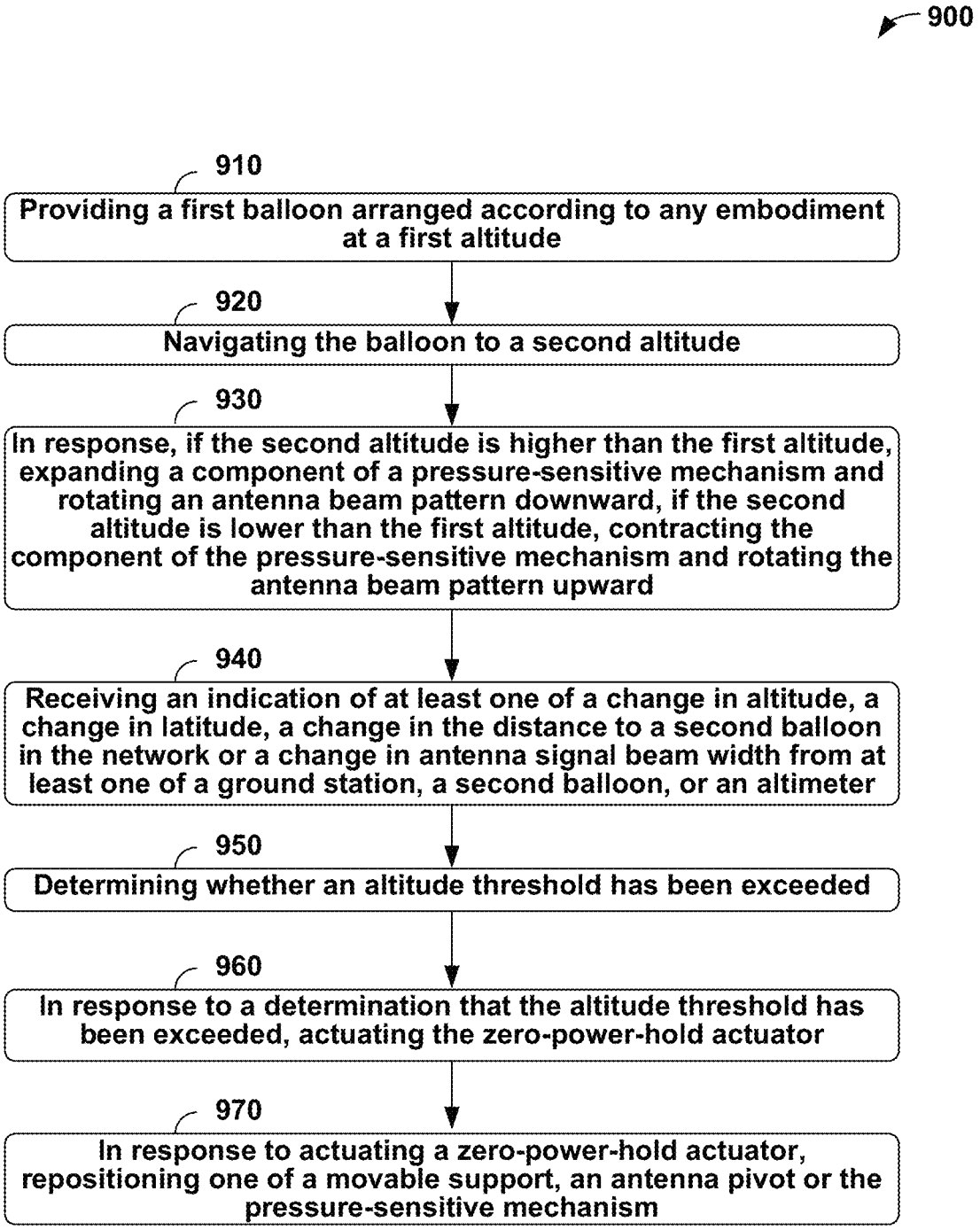
FIG. 9 is a flow chart of a method according to an example embodiment.

FIG. 9 is a flow chart of a method, according to an example embodiment. Example methods, such as method 900 of FIG. 9, may be carried out by a control system and/or by other components of the balloon. A control system may take the form of program instructions stored on a non-transitory computer readable medium (e.g., memory 314 of FIG. 3) and a processor that executes the instructions (e.g., processor 312). However, a control system may take other forms including software, hardware, and/or firmware.

Example methods may be implemented as part of a balloon's passive antenna steering process. As shown by block 910, method 900 involves providing a first balloon arranged according to any of the embodiments discussed in section 4 at a first altitude. Then at block 920, a control system navigates the first balloon to a second altitude. In response to the change in altitude, at block 930, a component of the pressure-sensitive mechanism (e.g., the flexible surface of the aneroid or the unrestrained end of the Bourdon tube) expands and rotates the antenna beam pattern downward, if the second altitude is higher than the first altitude. Alternatively, if the second altitude is lower than the first altitude, the component of the pressure-sensitive mechanism contracts and rotates the antenna beam pattern upward. Rotation of the beam pattern may be accomplished by physically rotating at least an element of the antenna (including a reflector), changing the separation distance between two or more radiating elements, or changing the separation distance between two or more radiating elements and a reflector. The expansion and contraction of the component of the pressure-sensitive mechanism is due to changes in the air pressure at different altitudes. Specifically, air pressure decreases as altitude increases and vice versa. In a further embodiment, the expansion of the component of the pressure-sensitive mechanism may also cause the separation distance to increase between the radiating elements themselves or between the reflector and the two or more radiating elements, while the contraction of the component of the pressure sensitive mechanism causes the separation distance to decrease.

In an additional aspect, an example method may further involve the control system receiving an indication of at least one of a change in altitude, a change in latitude, a change in the distance to a second balloon in the network or a change in antenna signal beam width from at least one of a ground station, a second balloon, or an altimeter, shown at block 940. The change in altitude, the change in latitude or the change in antenna signal beam width can be for one or both of the first balloon or the second balloon. The control system then determines at block 950 whether a positioning threshold has been exceeded. The positioning threshold can be a function one or more of an altitude of the first balloon, an altitude of the second balloon, the distance from the first balloon to the second balloon, the antenna signal beam width of the first balloon or the antenna signal beam width of the second balloon. In response to a determination that the positioning threshold has been exceeded, the control system actuates the zero-power-hold actuator at block 960. Actuation of the zero-power-hold actuator is discussed in further detail above in section 4. In a further aspect, an example method may further involve repositioning a movable support, an antenna pivot or the antenna in response to actuating a zero-power-hold actuator, at block 970. Other examples are also possible.

6. Conclusion

The above detailed description describes various features and functions of the disclosed systems, devices, and methods with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A balloon, comprising:

an antenna; and a pressure-sensitive mechanism in mechanical communication with the antenna such that in response to a change in the balloon's altitude, the pressure-sensitive mechanism causes a signaling end of the antenna to rotate about a pivot point on the antenna, a separation distance between two or more radiating elements of the antenna to increase or decrease, or a separation distance between the two or more radiating elements and a reflector of the antenna to increase or decrease.

2. The balloon of claim 1, wherein the pressure-sensitive mechanism comprises an aneroid or a Bourdon tube.

3. The balloon of claim 1, wherein the pressure-sensitive mechanism comprises an aneroid, wherein the aneroid defines an enclosed chamber with a first surface, a second surface and at least one collapsible sidewall disposed between the first surface and the second surface, wherein the chamber contains a partial vacuum, wherein the first surface is fixedly mounted and the second surface is movable relative to the first surface, and wherein contraction of the aneroid causes an element of the antenna to rotate in a first direction and expansion of the aneroid causes an element of the antenna to rotate in a second direction opposite from the first direction.

4. The balloon of claim 1, further comprising a calibration system comprising a zero-power-hold actuator and a processor, wherein the zero-power-hold actuator is in mechanical communication with the antenna.

5. The balloon of claim 4, wherein the calibration system further includes a movable support, wherein the zero-power-hold actuator acts upon the movable support.

6. The balloon of claim 5, wherein the pressure-sensitive mechanism comprises an aneroid and wherein a first surface of the aneroid is coupled to the movable support.

7. The balloon of claim 6, wherein a base end of the antenna is statically mounted to a second surface of the aneroid.

8. The balloon of claim 5, wherein the calibration system further includes an adjustment element that acts as an interface between the zero-power-hold actuator and the movable support.

9. The balloon of claim 5, wherein the calibration system further includes a tension spring with a first end and a second end, wherein the first end of the tension spring is coupled either directly or indirectly to the antenna, wherein the second end of the tension spring is coupled to the movable support.

10. The balloon of claim 3, further comprising a counterweight in the form of a biasing spring, wherein the biasing spring has a first end that is fixedly mounted and a second end that is coupled to the movable second surface of the aneroid.

11. The balloon of claim 3, wherein the second surface of the aneroid is arranged relative to the first surface of the aneroid such that the second surface moves along a shared axis with the first surface.

12. The balloon of claim 3, wherein the second surface of the aneroid is arranged to pivot relative to the first surface of the aneroid.

13. The balloon of claim 1, wherein the pressure-sensitive mechanism comprises an aneroid, wherein the aneroid defines an enclosed chamber with a flexible surface that expands and contracts, and wherein a contraction of the aneroid causes an element of the antenna to rotate in a first direction and an expansion of the aneroid causes an element of the antenna to rotate in a second direction opposite from the first direction.

14. The balloon of claim 1, wherein the pressure-sensitive mechanism comprises a Bourdon tube, wherein a contraction of the Bourdon tube causes an element of the antenna to rotate in a first direction and an expansion of the Bourdon tube causes an element of the antenna to rotate in a second direction opposite from the first direction.

15. The balloon of claim 4, wherein the calibration system further includes memory accessible by the processor and machine-language instructions stored in the memory that when executed by the processor causes the balloon to carry out functions including:

receiving an indication of at least one of a change in altitude, a change in latitude, a change in the distance to a second balloon in the network or a change in antenna signal beam width from at least one of a ground station, a second balloon, or an altimeter;

determining whether a positioning threshold has been exceeded; and in response to a determination that the positioning threshold has been exceeded, actuating the zero-power-hold actuator.

16. A method comprising:

operating a first balloon at a first altitude, wherein the balloon comprises an antenna, and a pressure-sensitive mechanism in mechanical communication with the antenna;

initiating an altitude change to move the balloon to a second altitude that is different from the first altitude; and in response to the altitude change, adjusting the position of a signaling end of the antenna, wherein adjusting the position of the antenna comprises:

if the second altitude is higher than the first altitude, expanding a component of the pressure-sensitive mechanism and rotating the signaling end of the antenna about a pivot point on the antenna toward the first altitude; and if the second altitude is lower than the first altitude, contracting the component of the pressure-sensitive mechanism and rotating the signaling end of the antenna about the pivot point on the antenna toward the first altitude.

17. The method of claim 16, further comprising:

receiving an indication of at least one of a change in altitude, a change in latitude, a change in the distance to a second balloon in a network or a change in antenna signal beam width from at least one of a ground station, a second balloon, or an altimeter determining whether a positioning threshold has been exceeded; and in response to a determination that the positioning threshold has been exceeded, actuating a zero-power-hold actuator.

18. The method of claim 17, wherein the positioning threshold is a function of at least one of an altitude of the first balloon, an altitude of the second balloon, the distance from the first balloon to the second balloon, the antenna signal beam width of the first balloon or the antenna signal beam width of the second balloon.

19. The balloon of claim 1, wherein the pressure-sensitive mechanism acts mechanically on the antenna to cause the signaling end to rotate about the pivot point, to increase or decrease the separation distance between the two or more radiating elements, or to increase or decrease the separation distance between the two or more radiating elements and the reflector.

20. The balloon of claim 1, further comprising an envelope and a payload, wherein the antenna is pivotably mounted to the envelope or the payload.

* * * * *